US008695912B2

(12) United States Patent
Tracey et al.

(10) Patent No.: US 8,695,912 B2
(45) Date of Patent: Apr. 15, 2014

(54) REEL SYSTEMS AND METHODS FOR MONITORING AND CONTROLLING LINEAR MATERIAL SLACK

(75) Inventors: James B. A. Tracey, Austin, TX (US); John P. Cunningham, Austin, TX (US)

(73) Assignee: Great Stuff, Inc., Austin, TX (US)

( * ) Notice: Subject to any disclaimer, the term of this patent is extended or adjusted under 35 U.S.C. 154(b) by 0 days.

(21) Appl. No.: 13/448,784

(22) Filed: Apr. 17, 2012

(65) Prior Publication Data

US 2012/0267466 A1 Oct. 25, 2012

Related U.S. Application Data

(60) Provisional application No. 61/477,108, filed on Apr. 19, 2011.

(51) Int. Cl.
*B65H 75/48* (2006.01)

(52) U.S. Cl.
USPC ..... 242/390.9; 242/419.5; 242/421.4

(58) Field of Classification Search
USPC ..... 242/390.1, 390.9, 419.2, 419.5, 421.2, 242/421.4; 191/12.2 R
See application file for complete search history.

(56) References Cited

U.S. PATENT DOCUMENTS

| | | | | |
|---|---|---|---|---|
| 2,039,915 | A | 12/1934 | McCoy | |
| 2,262,462 | A | 5/1941 | Margis, Jr. | |
| 2,353,639 | A | 11/1941 | Berthold et al. | |
| 3,160,173 | A | 12/1964 | Bowen | |
| 3,558,026 | A | 1/1971 | Rosen | |
| 3,788,575 | A | 1/1974 | Boettcher et al. | |
| 4,241,884 | A | 12/1980 | Lynch | |
| 4,454,999 | A | 6/1984 | Woodruff | |
| 4,537,364 | A | 8/1985 | Pollman et al. | |
| 4,565,099 | A | 1/1986 | Arnold | |
| 4,655,399 | A * | 4/1987 | Harvey | 239/745 |

(Continued)

FOREIGN PATENT DOCUMENTS

| | | |
|---|---|---|
| DE | 556596 | 8/1932 |
| DE | 44 07 195 C1 | 4/1995 |

(Continued)

OTHER PUBLICATIONS

International Search Report and Written Opinion, PCT/US2012/034128, mailing date Oct. 18, 2012 in 10 pages.

(Continued)

*Primary Examiner* — Sang Kim
(74) *Attorney, Agent, or Firm* — Knobbe, Martens, Olson & Bear, LLP

(57) ABSTRACT

A reel comprises a motorized spool member about which a linear material can be wound. A housing surrounds the spool member and has a port through which the linear material extends. A motor controller detects when the linear material is pulled from the spool member through the port, and responds by operating a motor to rotate the spool member in an unwind direction. During this operation, the motor controller (1) uses a spool sensor system to detect an unwind rate at which the linear material is unwound from the spool member, (2) uses a translation sensor system to detect a pull-out rate at which the linear material is pulled through the port in the unwind direction, and (3) adjusts the motor speed based on the detected rates, to limit a length of unwound linear material between the spool member and the port to less than a predetermined length.

27 Claims, 18 Drawing Sheets

(56) References Cited

U.S. PATENT DOCUMENTS

| | | | |
|---|---|---|---|
| 4,666,097 | A | 5/1987 | Tsuge et al. |
| 4,708,301 | A | 11/1987 | Kataoka |
| 4,718,168 | A | 1/1988 | Kerr |
| 4,744,696 | A | 5/1988 | Vidler |
| 4,775,086 | A | 10/1988 | Kataoka |
| 4,787,569 | A | 11/1988 | Kanada et al. |
| 4,852,263 | A | 8/1989 | Kerr |
| 4,893,037 | A | 1/1990 | Schwartz |
| 5,005,777 | A | 4/1991 | Fernandez |
| 5,160,055 | A | 11/1992 | Gray |
| 5,294,066 | A | 3/1994 | Lacour |
| 5,398,911 | A | 3/1995 | Holster |
| 5,440,820 | A | 8/1995 | Hwang |
| 5,495,995 | A | 3/1996 | Dominique et al. |
| 5,502,358 | A | 3/1996 | Lee |
| 5,526,997 | A | 6/1996 | Karczmer et al. |
| 5,762,282 | A | 6/1998 | Wolner |
| 5,793,174 | A | 8/1998 | Dkovach et al. |
| 5,808,824 | A | 9/1998 | Kaniwa et al. |
| 5,841,259 | A | 11/1998 | Kim et al. |
| 6,057,658 | A | 5/2000 | Kovach et al. |
| 6,149,096 | A | 11/2000 | Hartley |
| 6,181,089 | B1 | 1/2001 | Kovach et al. |
| 6,279,848 | B1 | 8/2001 | Mead, Jr. |
| 6,369,530 | B2 | 4/2002 | Kovach et al. |
| 6,474,588 | B2 | 11/2002 | Valverde |
| 6,474,922 | B2 | 11/2002 | Bachman et al. |
| 6,536,615 | B2 | 3/2003 | Nishikino et al. |
| 6,672,529 | B2 | 1/2004 | Cain et al. |
| 6,782,662 | B2 | 8/2004 | McCartney et al. |
| 6,913,221 | B2 | 7/2005 | Moon et al. |
| 6,941,802 | B2 | 9/2005 | Brown |
| 6,983,907 | B2 | 1/2006 | Ikuta et al. |
| 6,995,682 | B1 | 2/2006 | Chen et al. |
| 7,028,989 | B2 | 4/2006 | Flynn et al. |
| 7,108,218 | B2 | 9/2006 | Chapman et al. |
| 7,150,425 | B2 | 12/2006 | Banaszkiewicz et al. |
| 7,159,851 | B1 | 1/2007 | Ross et al. |
| 7,175,122 | B2 | 2/2007 | Bui et al. |
| 7,185,881 | B2 | 3/2007 | Drarvik et al. |
| 7,207,746 | B1 | 4/2007 | Legun |
| 7,331,436 | B1 | 2/2008 | Pack et al. |
| 7,350,736 | B2 | 4/2008 | Caamano et al. |
| 7,364,106 | B2 | 4/2008 | Bui et al. |
| 7,419,038 | B2 | 9/2008 | Caamano et al. |
| 7,431,268 | B2 | 10/2008 | Steiner et al. |
| 7,503,338 | B2 | 3/2009 | Harrington et al. |
| 7,533,843 | B2 | 5/2009 | Caamano et al. |
| 7,644,442 | B2 | 1/2010 | Miller et al. |
| 7,682,094 | B2 | 3/2010 | McNestry et al. |
| 7,688,010 | B2 | 3/2010 | Caamano et al. |
| 7,692,393 | B2 | 4/2010 | Caamano et al. |
| 7,722,268 | B2 | 5/2010 | McNestry et al. |
| 7,748,917 | B2 | 7/2010 | McNestry et al. |
| D626,818 | S | 11/2010 | Tracey |
| 7,838,892 | B2 | 11/2010 | Wirth |
| D632,548 | S | 2/2011 | Tracey et al. |
| 8,006,958 | B2 | 8/2011 | Starks et al. |
| 2004/0155137 | A1 | 8/2004 | Sharpe et al. |
| 2005/0040276 | A1 | 2/2005 | Sharpe et al. |
| 2005/0082517 | A1 | 4/2005 | Steiner et al. |
| 2006/0000936 | A1 | 1/2006 | Caamano et al. |
| 2007/0194163 | A1 | 8/2007 | Okonsky et al. |
| 2008/0074893 | A1 | 3/2008 | Ham, II |
| 2008/0223951 | A1 | 9/2008 | Tracey et al. |
| 2013/0015284 | A1 | 1/2013 | Tracey et al. |
| 2013/0171865 | A1 | 7/2013 | Ceraldi et al. |

FOREIGN PATENT DOCUMENTS

| | | |
|---|---|---|
| DE | 20304085 | 7/2003 |
| EP | 0289475 | 11/1988 |
| EP | 0953536 | 11/1999 |
| EP | 1457450 | 9/2004 |
| FR | 2 630 419 A1 | 10/1989 |
| GB | 946662 | 1/1964 |
| JP | 10-297821 | 11/1998 |
| JP | 11-21022 | 1/1999 |
| JP | 2000-219435 | 8/2000 |
| JP | 2003-221166 | 8/2003 |
| JP | 2004-059302 | 2/2004 |
| JP | 2004-067328 | 3/2004 |
| JP | 2007-070008 | 3/2007 |
| JP | 2007-519508 | 7/2007 |
| WO | WO 95/09123 A1 | 4/1995 |
| WO | WO 98/21138 A1 | 5/1998 |
| WO | WO 2010/015966 A1 | 2/2010 |

OTHER PUBLICATIONS

Ishihara, et al., AC Drive System for Tension Reel Control, Industry Applications, Jan. 1985, pp. 147-153, vol. IA-21-Issue 1.

International Search Report and Written Opinion mailed on Jul. 11, 2012 in PCT Application No. PCT/US2012/034126.

ThomasNet News, Thomas Publishing Company, Wire Pay-Out is suited for traverse wound reels, http://news.thomasnet.com/fullstory/454371 as of Aug. 10, 2004.

Warn Industries, The Basic Guide to Winching Techniques, http://www.warn.com/corporate/images/90/TechGuide_PN62885-A2.pdf as of Aug. 24, 2009.

General Machine Products Co., General Machine Products Co., Inc., Terminal Wire Reel, http://www.gmptools.com/nf/80470.htm as of Aug. 24, 2009.

Vimala, P., and K. Narayanan, Indirect Tension Control for Winder, Proceedings of the 2007 International Conference on Embedded Systems & Applications, ESA 2007, Jun. 25-28, 2007, pp. 74-80, CSREA Press, Las Vegas NV.

Nordic, Hose Boss Rewind Assist, found at http://web.archive.org/web/20031212090707/http://www.nordicsystems.com/hoseboss.php, dated Dec. 12, 2003.

Communication relating to the results of a partial International Search Report mailed Nov. 12, 2005, in Application No. PCT/US2005/023652, 5 pages.

European Search Report for application No. 10178366.0, dated Oct. 28, 2010.

International Search Report and Written Opinion mailed Apr. 27, 2006; Appl. No. PCT/US2005/023652; 13 pages.

* cited by examiner

REEL SYSTEMS AND METHODS FOR MONITORING AND CONTROLLING LINEAR MATERIAL SLACK

CLAIM FOR PRIORITY

The present application claims priority to U.S. Provisional Patent Application No. 61/477,108, filed Apr. 19, 2011.

INCORPORATION BY REFERENCE

The present application incorporates by reference the entire disclosures of U.S. Pat. Nos. 6,279,848; 7,320,843; 7,350,736; 7,503,338; 7,533,843; and D632,548; and U.S. Patent Application Publication No. US2008/0223951 A1. The present application also incorporates by reference the entire disclosure of U.S. Provisional Patent Application No. 61/477,108, filed Apr. 19, 2011, with the exception of paragraphs [0020]-[0021], [0050], [0171]-[0177], the heading immediately preceding paragraph [0171], Claims 45-57 and 66, and FIG. 17.

BACKGROUND

1. Field

The present disclosure relates generally to systems and methods for winding and unwinding linear material and, in particular, to a motorized reel having a motor controller for controlling the same.

2. Description of the Related Art

Linear material, such as hoses, ropes, cables, and electrical cords, can be cumbersome and difficult to manage. Mechanical reels have been designed to help wind such linear material onto a spool member. As used herein, a spool member is an element on which a linear material can be wound and unwound, such as a cylindrical drum. Some conventional reels are manually operated, requiring the user to physically rotate the spool member to wind the linear material about the spool member. This can be tiresome and time-consuming for users, especially when the linear material is of a substantial length. Other reels are motor-controlled, and can automatically wind up the linear material. These automatic reels often have a gear assembly wherein multiple revolutions of the motor cause a single revolution of the spool member. For example, some conventional automatic reels have a 30:1 gear reduction, wherein 30 revolutions of the motor result in one revolution of the spool member.

However, when a user attempts to pull out the linear material from the automatic reel, the user must pull against the increased resistance caused by the gear reduction because the motor spins 30 times for every full revolution of the spool member. Not only does this place an extra physical burden on the user, but the linear material experiences additional strain as well. Some automatic reels include a clutch system, such as a neutral position clutch, that neutralizes (or de-clutches) the motor to enable the user to freely pull out the linear material. This often requires the user to be at the site of the reel to activate the clutch. In addition, clutch assemblies can be expensive and substantially increase the cost of automatic reels.

For these reasons, some motorized reels include a motor controller that provides a "powered-assist" (also known as "reverse-assist") feature, in which the motor controller detects when a user pulls the linear material from the spool member, and responds by operating the motor to rotate the spool member in a direction that unwinds the linear material. Powered-assist thereby reduces the pulling burden that is otherwise placed on the user. In one known implementation, the motor controller detects when a tension in the linear material exceeds a predetermined threshold, and responds by signaling the motor to rotate the spool member in an unwind direction.

Conventional automatic reel motors also tend to rotate the spool member at a constant rate. As a result, when the end portion of the linear material is being wound upon the spool member, such rotation can cause the end of the linear material to swing uncontrollably or even hit forcefully against the reel unit. This erratic movement can result in property damage or serious injury to nearby persons who may be hit by the linear material. Oftentimes, the user must also push a button or activate a control to stop the spool member from rotating. To account for such problems, some automatic reels incorporate encoders that keep track of the amount of linear material left to be wound. By tracking the amount of unwound linear material, a reel's motor controller can reduce the wind-up speed of the spool member when winding in the terminal end portion of the linear material. This feature is known as "docking."

SUMMARY

When a linear material is released or expelled (such as by a powered-assist feature of a reel) from a source (such as a spool member), it is possible for slack to develop if the released linear material is not pulled away from the source. Slack may develop when the rate at which the linear material is released is greater than the rate at which it is pulled away. In different contexts, it may be desirable to maintain a certain amount of slack between one location, such as the source of the linear material, and another location. For example, in some contexts it may be desirable for the linear material to be as taut as possible. In other contexts it may be desirable that there be a certain range of slack. Too much slack can lead to, among other things, tangling and knotting.

In some embodiments, an apparatus for detecting and ameliorating high slack scenarios or high tangle-probability scenarios is provided. Some embodiments of the apparatus comprise a rotatable spool member from which a linear material may be unwound or around which it may be wound; a spool sensor system capable of detecting the length of linear material unwound from or wound around the spool member; a translation sensor system (referred to as a "transmission sensor system" in U.S. Provisional Application No. 61/477,108 filed Apr. 19, 2011) capable of detecting the length of linear material that has passed a monitored location; and a control system configured to receive input from both the spool sensor system and the translation sensor system, calculate an amount of slack in the linear material (e.g., the length of linear material between the spool member and the monitored location, minus the shortest possible linear material length between the spool member and the monitored location), and output a signal to cause the spool member to rotate in a way calculated to adjust the amount of slack in the linear material or the rate at which the amount of slack increases. For example, the control system can output a signal to cause the spool member to rotate in a way calculated to reduce the amount of slack or decrease the rate at which the amount of slack forms or increases.

In some embodiments, the rate of release of linear material (e.g., unwinding of the linear material from a spool member in a powered-assist operation) is controlled to be substantially equal to the rate at which the linear material is pulled away ("pull-out rate"), thereby minimizing any initial variance from the desired degree of slack. In some embodiments, sensors detect the rates at which the released linear material translates past two locations. By comparing the observations of these sensors, the amount of slack between the two locations can be determined. In certain embodiments, based on the results of the comparison or even based on the results of the observations of one of the sensors, corrective action is taken, such as adjusting the rate at which linear material is released from a source such as a spool member.

In another aspect, the present disclosure provides a reel comprising a linear material, a spool member rotatable about a winding axis, a motor configured to rotate the spool member about the winding axis, a housing surrounding the spool member and motor, a motor controller, a spool sensor system, and a translation sensor system. The spool member is configured to rotate in a wind direction about the winding axis to wind the linear material about the spool member. The spool member is also configured to rotate in an unwind direction about the winding axis to unwind the linear material from the spool member. The housing has a spooling port through which the linear material extends. The motor controller is configured to detect when the linear material is pulled from the spool member through the port, and to respond to the detected pulling of the linear material by conducting a powered-assist operation in which the motor controller operates the motor to rotate the spool member about the winding axis in the unwind direction. The spool sensor system is configured to be used by the motor controller to detect an unwind rate at which the linear material is unwound from the spool member during the powered-assist operation. The translation sensor system is configured to be used by the motor controller to detect a pull-out rate at which the linear material is pulled through the port in an unwind direction during the powered-assist operation. The motor controller is configured to adjust a rotation speed of the motor during the powered-assist operation based at least partly on the unwind rate and the pull-out rate, in order to limit a length of unwound linear material between the spool member and the port to less than a predetermined length.

In another aspect, the present disclosure provides a method comprising the following. The method includes providing a linear material being connected to a rotatable spool member housed within a housing. The spool member is rotatable about a winding axis. The spool member is configured to rotate in a wind direction about the winding axis to wind the linear material about the spool member, and is also configured to rotate in an unwind direction about the winding axis to unwind the linear material from the spool member. The housing has a port through which the linear material extends. The method further includes detecting the linear material being pulled from the spool member through the port; responding to the detected pulling of the linear material by conducting a powered-assist operation in which a motor rotates the spool member about the winding axis in the unwind direction; detecting an unwind rate at which the linear material is unwound from the spool member during the powered-assist operation; detecting a pull-out rate at which the linear material is pulled through the port in the unwind direction during the powered-assist operation; and adjusting a rotation speed of the motor during the powered-assist operation based at least partly on the unwind rate and the pull-out rate, in order to limit a length of unwound linear material between the spool member and the port to less than a predetermined length.

In still another aspect, the present disclosure provides a reel comprising a linear material, a spool member rotatable about a winding axis, a motor configured to rotate the spool member about the winding axis, a housing surrounding the spool member and motor, a motor controller configured to control rotation of the motor, a spool sensor system, and a translation sensor system. The spool member is configured to rotate in a wind direction about the winding axis to wind the linear material about the spool member. The spool member is also configured to rotate in an unwind direction about the winding axis to unwind the linear material from the spool member. The housing has a spooling port through which the linear material extends. The spool sensor system is configured to be used by the motor controller to detect a first rate at which the linear material is wound upon or unwound from the spool member. The translation sensor system is configured to be used by the motor controller to detect a second rate at which the linear material translates through the port in a wind-up direction or an unwind direction. The motor controller is configured to control the motor based at least partly on the first and second rates, in order to limit a length of unwound linear material between the spool member and the port to less than a predetermined length.

For purposes of summarizing the disclosure, certain aspects, advantages and novel features of the invention have been described herein. It is to be understood that not necessarily all such advantages may be achieved in accordance with any particular embodiment of the invention. Thus, the invention may be embodied or carried out in a manner that achieves or optimizes one advantage or group of advantages as taught herein without necessarily achieving other advantages as may be taught or suggested herein.

DETAILED DESCRIPTION OF THE PREFERRED EMBODIMENTS

Automatic Reel

Figure 1A:
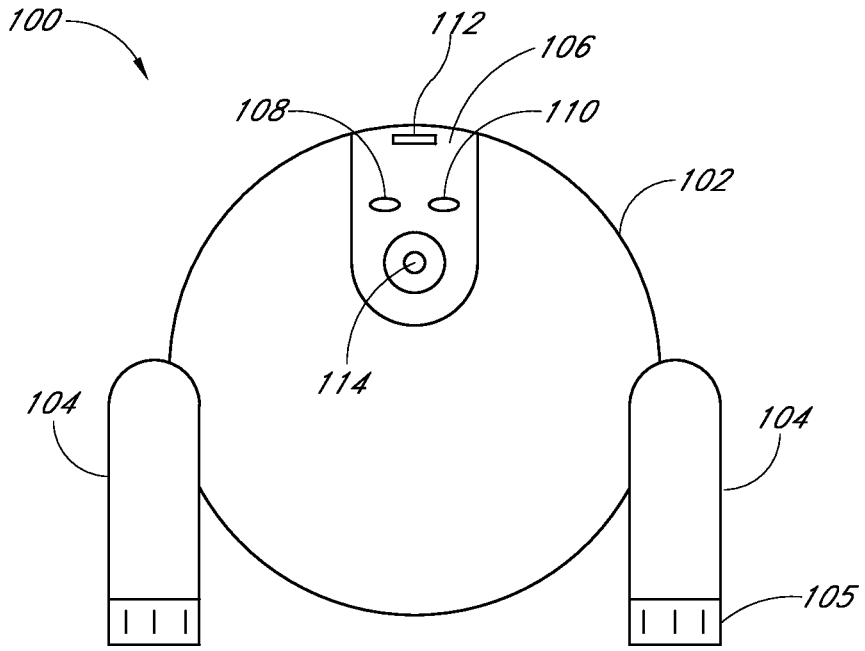
FIG. 1A is a front elevation view of an embodiment of an automatic reel.

FIG. 1A illustrates an automatic reel 100 according to one embodiment of the invention. The illustrated automatic reel 100 is structured to spool a water hose, such as used in a garden or yard area. Other embodiments of the automatic reel 100 may be structured to spool, without limitation, air hoses, pressure hoses, ropes, electrical cords, cables, or other types of linear material that are used in a home setting, a commercial or industrial setting, or other settings.

The illustrated automatic reel 100 comprises a body or housing 102 supported by a base or leg structure, such as a plurality of legs 104 (e.g., four legs of which two legs are shown in FIG. 1A). The housing 102 advantageously houses several components, such as a motor, a motor controller, a rotatable spool member (such as a rotating drum), portions of the linear material (e.g., a hose) wound onto the spool member, and the like. The housing 102 is preferably constructed of a durable material, such as a hard plastic. In other embodiments, the housing 102 may be constructed of a metal or other suitable material. In certain embodiments, the housing 102 has a sufficient volume to accommodate a reel that holds a standard garden hose of approximately 100 feet in length. In other embodiments, the housing 102 is capable of accommodating a reel for holding a standard garden hose of greater than 100 feet in length.

The illustrated legs 104 support the housing 102 above a surface such as ground (e.g., a lawn), a floor, or a table-top. The legs 104 may also advantageously include wheels, rollers, or other like devices 105 to enable movement of the automatic reel 100 on the ground or other supporting surface. In certain embodiments, the legs 104 are capable of locking or being affixed to a certain location to prevent lateral movement of the automatic reel 100.

The illustrated automatic reel 100 also comprises an interface panel 106, which can include a power button 108, a select button 110 and an indicator light 112. The power button 108 controls the operation of the motor, which controls the automatic reel 100. For example, pressing the power button 108 activates the motor when the motor is in an off or inactive state. In certain embodiments, in order to account for premature commands or electrical glitches, the power button 108 may be required to be pressed for a predetermined time or number of times, such as, for example, at least about 0.1 seconds before turning on the motor. In addition, if the power button 108 is pressed and held for longer than a predetermined time period (e.g., about 3 seconds), the automatic reel 100 may turn off the motor and generate an error signal (e.g., activate the indicator light 112).

In some embodiments, if the power button 108 is pressed while the motor is running, the motor is turned off. Preferably, commands issued through the power button 108 override any commands received from a remote control device (discussed below). In certain embodiments, the power button 108 may be required to be pressed for more than about 0.1 second to turn off the motor.

The illustrated interface panel 106 also includes the select button 110. The select button 110 may be used to select different options available to the user of the automatic reel 100. For example, a user may depress the select button 110 to indicate the type or size of linear material used with the automatic reel 100. In other embodiments, the select button 110 may be used to select a winding speed for the automatic reel 100.

The illustrated indicator light 112 can provide information to a user regarding the functioning of the automatic reel 100. In an embodiment, the indicator light 112 comprises a fiber-optic indicator that includes a translucent button. In certain embodiments, the indicator light 112 is advantageously structured to emit different colors or to emit different light patterns to signify different events or conditions. For example, the indicator light 112 may flash a blinking red signal to indicate an error condition.

In other embodiments of the invention, the automatic reel 100 may comprise indicator types other than the indicator light 112. For example, the automatic reel 100 may include an indicator that emits an audible sound or tone.

Although the interface panel 106 is described with reference to particular embodiments, the interface panel 106 may include more or less buttons (or other control elements) usable to control the operation of the automatic reel 100. For example, in certain embodiments, the automatic reel 100 advantageously comprises an "on" button and an "off" button. Also, the interface panel 106 can include devices for implementing an interface 208 (FIG. 2) of a spooling control system 200, described below.

Furthermore, the interface panel 106 may include other types of control elements, displays, or devices that allow for communication to or from a user. For example, the interface panel 106 may include a liquid crystal display (LCD), a touch screen, one or more knobs or dials, a keypad, combinations of the same or the like. The interface panel 106 may also advantageously include an RF receiver that receives signals from a remote control device, such as signals for operating the motor or a flow controller regulating fluid flow through the linear material (e.g., hose). Examples configurations of remote controls for controlling a flow controller and the reel motor 204 are disclosed in U.S. Pat. No. 7,503,338 to Harrington et al. and U.S. Patent Application Publication No. US2008/0223951A1 to Tracey et al. In some embodiments, an RF receiver can be located elsewhere within the reel 100, and not on the interface panel 106.

The automatic reel 100 is preferably powered by a battery source. For example, the battery source may comprise a rechargeable battery. In an embodiment, the indicator light 112 is configured to display to the user the battery voltage level. For example, the indicator light 112 may display a green light when the battery level is high, a yellow light when the battery life is running out, and a red light when the battery level is low. An example of a suitable battery is disclosed in U.S. Pat. No. 7,320,843 to Harrington.

In certain embodiments, the automatic reel 100 is configured to shut down the motor when the linear material is in a fully unwound state (or at least unwound as much as possible).

In addition to, or instead of, utilizing battery power, other sources of energy may be used to power the automatic reel 100. For example, the automatic reel 100 may comprise a cord that electrically couples to an AC outlet. In other embodiments, the automatic reel 100 may comprise solar cell technology or other types of powering technology.

As further illustrated in FIG. 1A, the automatic reel 100 comprises a spooling port or aperture 114. The spooling port 114 provides a location on the housing 102 through or over which a linear material may be wound or unwound. In some embodiments, the spooling port 114 comprises an aperture having a circular shape with a diameter of approximately 1 to 3 inches, such as to accommodate a standard garden hose. In other embodiments, the spooling port 114 comprises an aperture having a diamond shape as disclosed in U.S. Design Pat. No. D632,548 to Tracey et al. In certain embodiments, the spooling port 114 is sized such that only the linear material passes therethrough during winding. In such embodiments, the size and shape of the spooling port 114 may be sufficiently small to block passage of a structure engaged on the linear material, such as a fitting and/or nozzle at the end of a hose.

Figure 1B:
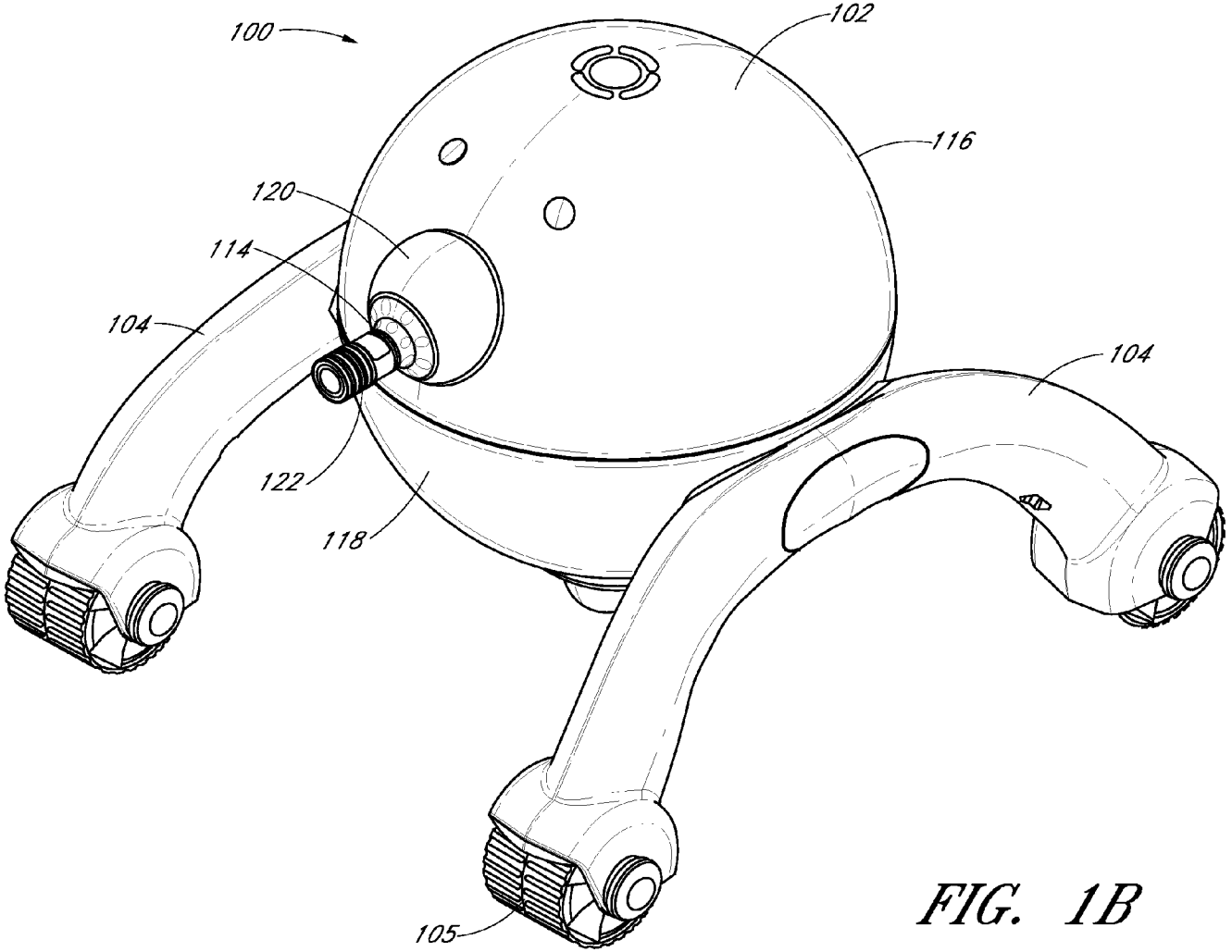
FIG. 1B is a top-right perspective view of another embodiment of an automatic reel.
Figure 1C:
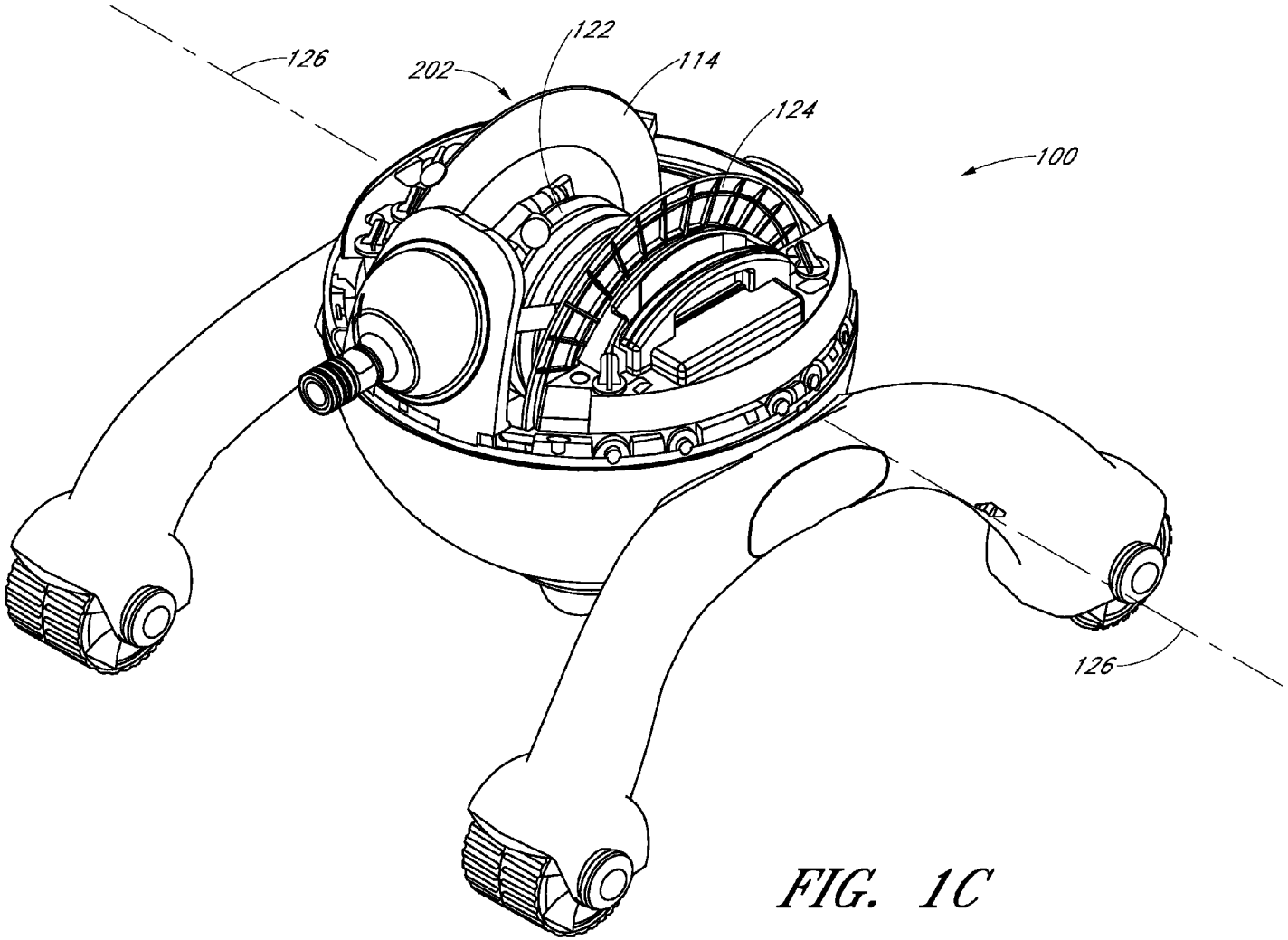
FIG. 1C is a top-right perspective view of the reel of FIG. 1B, with an upper housing portion removed to show internal components.

FIGS. 1B and 1C illustrate another embodiment of an automatic reel 100. The illustrated reel 100 includes a housing 102, a pair of legs 104, and four wheels 105 substantially as described above. The illustrated housing 102 is spherical (but can have other shapes) and comprises an upper housing portion 116 and a lower housing portion 118 that rotate with respect to each other about a vertical axis. Further details concerning this relative rotation are provided in U.S. Pat. No. 7,533,843 to Caamano et al. In the embodiment of FIGS. 1B and 1C, the housing includes a "nosecone" 120, with the spooling port 114 being formed within the nosecone. The nosecone 120 is described in further detail below. FIGS. 1B and 1C also show a linear material 122 (illustrated as a hose) wound onto a rotatable spool member 202. In this embodiment, the spool member 202 comprises a cylindrical drum sandwiched between two end plates 124. It will be understood that a spool member can have a large variety of shapes, including non-cylindrical shapes, polyhedral shapes, curved shapes, etc. It will also be understood that a spool member can have a large variety of configurations, including apertured and non-apertured tubular structures, groups of parallel rods, cage-like structures, etc. The illustrated spool member 202 is rotatable about a winding axis 126 to wind or unwind the linear material 122 onto and/or from the cylindrical drum between the end plates 124.

A skilled artisan will recognize from the disclosure herein a variety of alternative embodiments, structures and/or devices usable with the automatic reel 100. For example, the reel 100 may comprises any support structure, any base, and/or any console usable with embodiments described herein.

Control System

Figure 2:
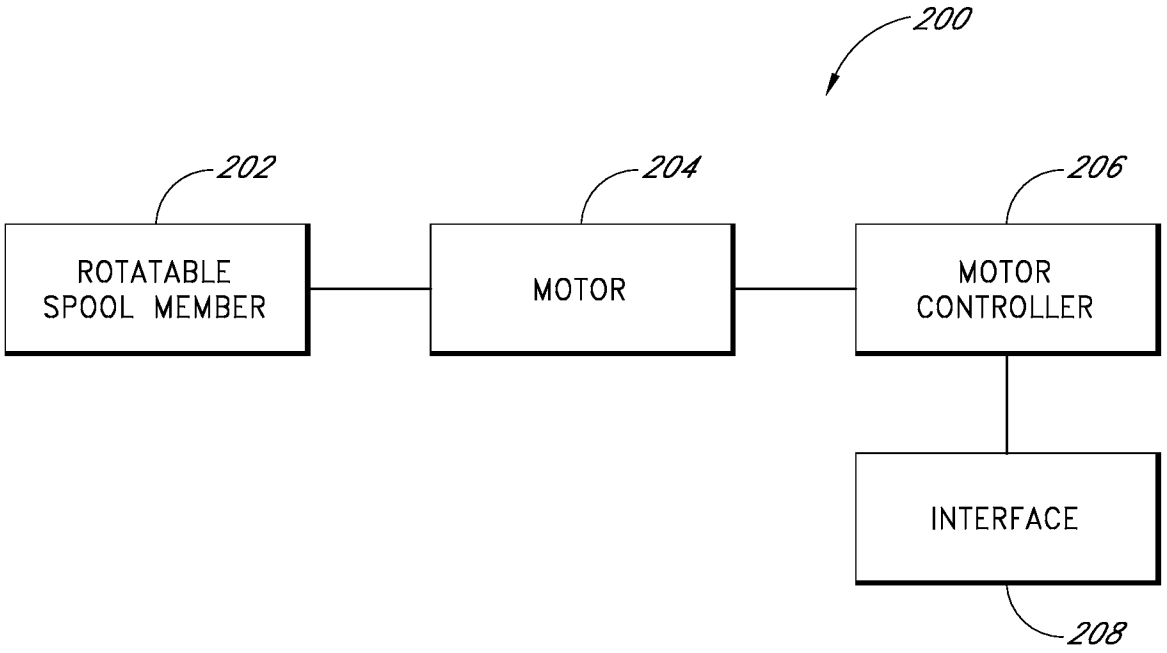
FIG. 2 is a block diagram of an embodiment of a control system usable by the automatic reels of FIGS. 1A-1C.

FIG. 2 illustrates a block diagram of an embodiment of a control system 200 configured to control the winding and/or unwinding of a linear material. In certain embodiments, the automatic real 100 advantageously houses the control system 200 within the housing 102.

As shown in the block diagram of FIG. 2, the control system 200 comprises a rotatable spool member 202, a motor 204, a motor controller 206 and an interface 208. In general, the spool member 202 is powered by the motor 204 to wind and/or unwind linear material, such as a hose. In certain embodiments, the motor controller 206 controls the operation of the motor 204 based on stored instructions, instructions received through the interface 208, and/or instructions received from a remote control. For example, the interface 208 can be the previously described interface panel 106 or a remote control.

In certain embodiments, the spool member 202 comprises a substantially cylindrical drum capable of rotating about a winding axis 126 to wind and unwind linear material. In other embodiments, the spool member 202 may comprise other devices suitable for winding and unwinding a linear material.

Referring to FIGS. 1 and 2, in certain embodiments a portion of the housing 102 is moveably attached to the base (e.g., legs 104) to allow a reciprocating back-and-forth lateral motion of the spooling port 114 across a length of the internal spool member 202 of the automatic reel 100 as the linear material is wound onto the spool member 202. This helps to produce smoother and more uniform winding of the linear material onto the spool member 202, as opposed to causing an inordinate amount of the wound linear material to become bunched at one location of the spool member 202. Examples of reciprocating mechanisms are described in more detail in U.S. Pat. Nos. 6,279,848 to Mead, Jr. and 7,533,843 to Caamano et al.

With reference to FIG. 2, in some embodiments the motor 204 of the automatic reel 100 comprises a brush DC motor (e.g., a conventional DC motor having brushes and having a commutator that switches the applied current to a plurality of electromagnetic poles as the motor rotates). The motor 204 advantageously provides power to rotate the spool member 202 inside the automatic reel 100 to wind the linear material onto the spool member 202, thereby causing the linear material to retract into the housing 102.

In an embodiment, the motor 204 is coupled to the spool member 202 via a gear assembly. For example, the automatic reel 100 may advantageously comprise a gear assembly having an about 30:1 gear reduction, wherein about 30 revolutions of the motor 204 produce about one revolution of the spool member 202. In other embodiments, other gear reductions may be advantageously used to facilitate the winding of linear material. In yet other embodiments, the motor may comprise a brushless DC motor 204, a stepper motor, or the like.

In certain embodiments, the motor 204 operates within a voltage range between about 10 and about 15 volts and consumes up to approximately 250 watts. In one embodiment, under normal load conditions, the motor 204 may exert a torque of approximately 120 ounce-inches (or approximately 0.85 Newton-meters) and operate at approximately 2,500 RPM. In some embodiments, the motor 204 is capable of operating within an ambient temperature range of approximately about 0° C. to about 40° C., allowing for a widespread use of the reel 100 in various types of weather conditions.

In certain embodiments, the motor 204 advantageously operates at a rotational velocity selected to cause the spool member 202 to completely wind up a 100-foot garden hose within approximately 20-60 seconds. However, as a skilled artisan will recognize from the disclosure herein, the wind-up time may vary according to the type of motor used and the type and length of linear material wound by the automatic reel 100.

In certain embodiments, the motor 204 is configured to wind linear material at a maximum translational velocity of, for example, between approximately 3 and approximately 4 feet per second. As used herein, "translational velocity" refers to the speed at which an unwound portion of the linear material translates due to winding or unwinding. In certain embodiments, the motor 204 is configured to wind linear material at a maximum translational velocity of approximately 3.6 feet per second. To maintain the linear material translational velocity below a selected maximum velocity, the motor 204 may advantageously operate at different speeds during a complete wind-up of the linear material. For instance, the translational velocity of the linear material may depend upon the number of layers of linear material wound on the spool member 202. Thus, in order to achieve a relatively high translational velocity when winding of the linear material begins, yet stay below the maximum translational velocity as the number of layers of linear material wound onto the spool member 202 increases, the motor controller 206 can be configured to decrease the rotational velocity (e.g., the RPM) of the spool member 202 as more linear material becomes wound onto the spool member 202.

One skilled in the art will recognize from the disclosure herein that the automatic reel 100 need not wind the linear material at a constant velocity. For example, the reel motor 204 may operate at a constant RPM throughout the winding process. In such an embodiment, the translational velocity of the linear material may increase as more layers of linear material become wound upon the spool member 202.

In one particularly advantageous embodiment, the rotational velocity of the motor 204 decreases during winding to reduce the translational velocity of the linear material when a relatively short length of linear material remains to be wound onto the spool member 202. Such a motor velocity reduction may protect against injury and property damage by preventing the end of the linear material from being too forcefully wound into the automatic reel 100. As mentioned above, this feature is known as "docking."

Powered-Assist

In certain embodiments, the automatic reel 100 preferably includes a powered-assist function (also referred to as "reverse-assist") to reduce the effort required by a user to pull (i.e., unwind) linear material from the spool member 202 within the automatic reel 100. The powered-assist function can counteract at least a portion of the effect of pulling against a large gear reduction of the automatic reel 100. For example, when the user pulls on the linear material, the internal spool member 202 rotates and causes the motor 204 to rotate in the unwind direction.

Figure 3:
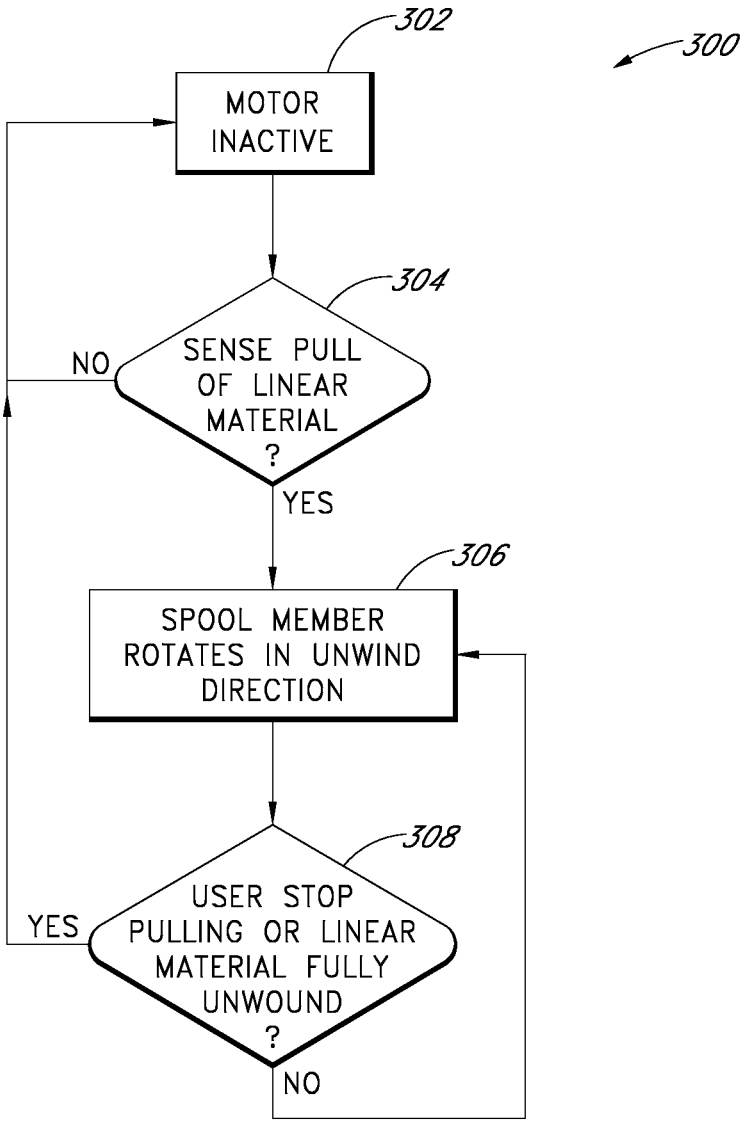
FIG. 3 is a flow chart of an embodiment of a powered-assist process usable by the control system of FIG. 2.

FIG. 3 is a flow chart of a powered-assist process 300 that facilitates the unwinding of linear material, such as a hose, from an automatic reel. The process 300 will be described with reference to the control system 200 components of FIG. 2.

The powered-assist process 300 begins at Block 302, wherein the motor 204 is in an inactive state. At Block 304, the motor controller 206 determines if the linear material is being pulled, such as by a user trying to unwind the linear material from the automatic reel 100. For example, in certain embodiments, the motor controller 206 detects a tension of the linear material above a predetermined amount, such as, for example, a tension that causes the motor 204 to spin in the reverse direction. If the motor controller 206 does not sense a pull or increased tension of the linear material, the process 300 returns to Block 302. If the motor controller 206 senses that the linear material is being pulled, the process 300 proceeds with Block 306.

In certain embodiments wherein the motor 204 comprises a brush DC motor, the motor controller 206 can be configured to sense a reverse electromotive force (EMF) associated with the motor 204, to determine when the linear material is being pulled. When the motor 204 is inactive, the motor controller 206 does not provide power to the motor 204. As the user pulls on the linear material, the turning of the brush DC motor generates a detectable reverse EMF, which is sensed by the motor controller 206. The motor controller 206 can be configured to respond to the detection of such reverse EMF (e.g., if it exceeds a certain magnitude) by initiating a powered-assist operation and possibly also by "waking up" (e.g., electrically activating) rotation sensors associated with a slack control system, such as rotation sensors used in a spool sensor system 402 and/or a translation sensor system 404 (described below with respect to FIGS. 4 and 5).

Once the motor controller 206 senses the pulling of the linear material, the motor controller 206 causes the motor 204 to rotate in an unwind direction, which causes the spool member 202 to unwind portions of the linear material wound thereon, which is illustrated by Block 306.

In certain embodiments, the motor controller 206 causes the spool member 202 to rotate in the unwind direction by operating a relay or other suitable switching device to reverse the direction of the current applied to the motor 204. The reverse current causes the motor 204 to rotate the spool member 202 of the automatic reel 100 such that the linear material is unwound from the spooling member 202.

At Block 308, the motor controller 206 determines if the user has stopped pulling the linear material or if the linear material has been fully unwound (or unwound as much as possible), and if so, the motor controller 206 causes the motor 204 to stop rotating in the unwind direction. If the user has not stopped pulling the linear material and ii the linear material is not fully unwound, the process 300 returns to Block 306 wherein the spool member 202 continues to rotate to unwind the linear material.

In certain alternative embodiments, rather than causing the motor 204 to rotate in the unwind direction until such time that the user stops pulling the linear material or until the linear material is fully unwound (as in Block 308), the motor controller 206 causes unwinding rotation of the motor 204 and the spool member 202 (in Block 306) for only a predetermined period of time. For example, when the motor controller 206 senses a pulling of the linear material (Block 304), the motor controller 206 may cause the spool member 202 to rotate to unwind linear material for five seconds. In other embodiments, the motor controller 206 may cause the spool member 202 to unwind a predetermined length of the linear material (e.g., approximately 10 feet) or may cause the spool member 202 to perform a certain number of revolutions (e.g., 10 revolutions).

Although described with reference to particular embodiments, the skilled artisan will recognize from the disclosure herein a wide variety of alternatives to the powered-assist process 300. For example, in certain embodiments, a remote control advantageously includes an "unwind" (or equivalent) button (not shown) to activate the automatic reel 100 to operate the motor 204 in the unwind direction to unwind the linear material from the spool member 202 within the automatic reel 100.

The skilled artisan will also readily appreciate from the disclosure herein that numerous modifications can be made to the electronics to operate the reel device 100. For example, the above process 300 may be implemented in software, in hardware, in firmware, or in a combination thereof. In addition, functions of individual components, such as the motor controller 206, may be performed by multiple components in other embodiments of the invention.

Skilled artisans will understand from the present disclosure how to construct a motor controller that implements a powered-assist process such as the process 300 of FIG. 3. It will be appreciated that the motor controller can include a microcontroller to implement motor functionality disclosed herein. Further details and schematics of electronic components operative to implement the powered-assist process 300 are disclosed in U.S. Pat. No. 7,350,736 to Caamano et al.

Slack Control System

In preferred embodiments, a reel includes a slack control system that monitors and/or reports on the amount or an approximation of "slack": the amount of linear material between a source of linear material (such as the spool member 202) and another location. A slack control system can help to reduce problems caused by excessive slack, such as knotting, tangling, and inefficient winding and unwinding.

Figure 4:
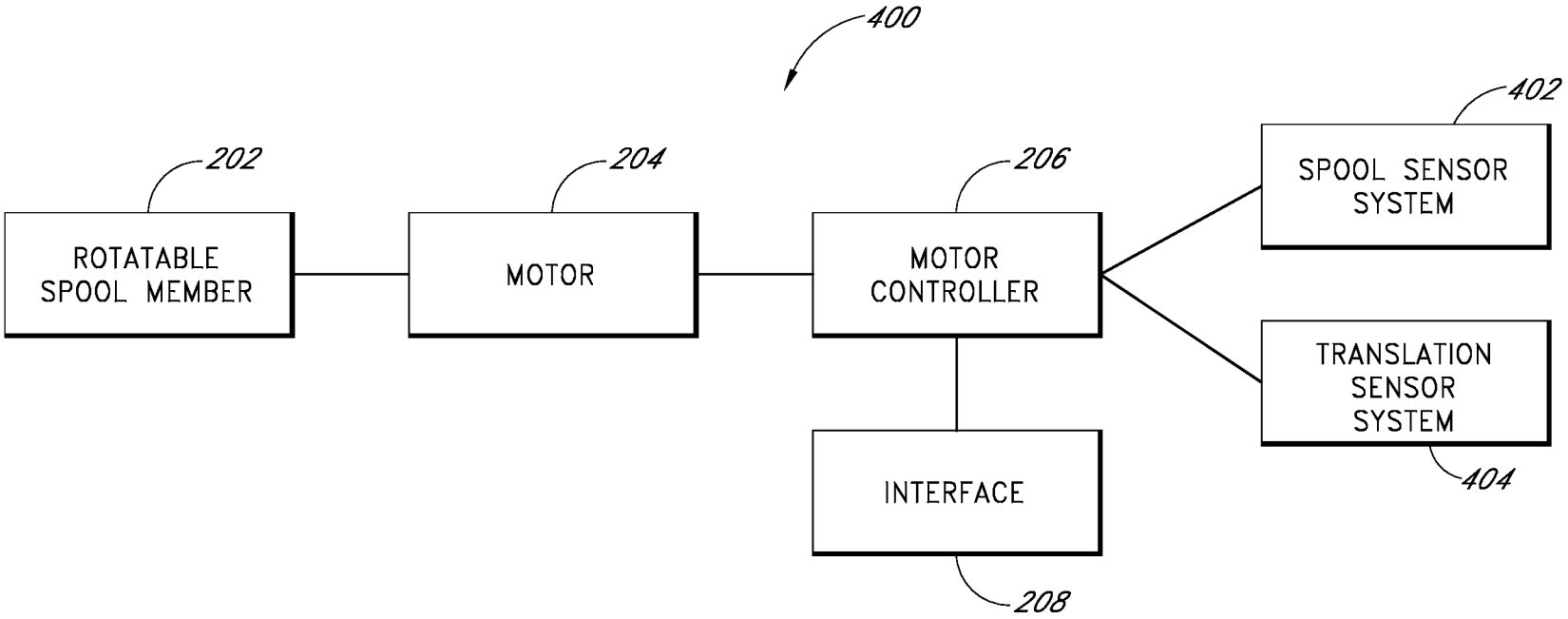
FIG. 4 is a block diagram of an embodiment of a slack control system.

As shown in the block diagram of FIG. 4, an embodiment of a slack control system 400 comprises the rotatable spool member 202, motor 204, motor controller 206, and motor controller interface 208, preferably as these elements have been described above. Additionally, the illustrated slack control system 400 includes a spool sensor system 402 and a translation sensor system 404, which are now described.

The spool sensor system 402 can enable the motor controller 206 to detect winding or unwinding translational movement and/or velocity of the linear material relative to the spool member 202, by monitoring revolutions and/or rotational velocity of the spool member 202, the motor output shaft 704 (FIGS. 7-8), or a rotating member operatively disposed between the spool member 202 and the motor 204 (such as a gear or gear shaft). For example, during a powered-assist operation, the spool sensor system 402 can be configured to be used by the motor controller 206 to detect an "unwind rate," i.e., a rate (e.g., in length per unit of time) at which linear material is unwound from the spool member 202.

The translation sensor system 404 can enable the motor controller 206 to detect winding or unwinding translational movement and/or velocity of the linear material at another location, typically a location near (e.g., within six inches) the spooling port 114. For example, during a powered-assist operation, the translation sensor system 404 can be configured to be used by the motor controller 206 to detect a rate at which the linear material is pulled (typically by a user) through the spooling port 114 in the unwind direction. This rate is referred to herein as a "pull-out rate."

In the illustrated embodiment, the slack control system 400 includes one spool sensor system 402 and one translation sensor system 404. In some alternative embodiments, a slack control system includes a plurality (e.g., a pair) of translation sensor systems 404, without a spool sensor system 402. For example, one translation sensor system 404 can be positioned near (e.g., within 2-6 inches) the spool member 202 to detect translational movement and/or velocity of linear material that is winding onto or unwinding from the spool member 202, and another translation sensor system 404 can be positioned at another location to detect those same properties at that location. This can enable the detection of slack between the two translation sensor systems 404. In still other embodiments, a slack control system includes a spool sensor system 402 and a plurality of translation sensor systems 404.

The illustrated slack control system 400 can be configured to be used by the motor controller 206 to monitor and/or report on the amount or an approximation of slack: the amount or length of linear material 122 (FIG. 5) between a source of linear material 122, such as the spool member 202, and another location, typically the one monitored by the translation sensor system 404. As noted above, other embodiments may monitor and/or report on the amount or an approximation of slack between two locations monitored by separate translation sensor systems 404.

In some contexts it is desirable that slack is minimized, while in others there is a desired range of slack. Some embodiments generate and send an alert or signal when the amount of slack exceeds (or falls below) a threshold. Some embodiments control the amount of slack, for example, by causing the motor controller 206 to send an appropriate signal to the motor 204 or to modify a signal already being sent. Such corrective action may be taken when appropriate, as determined by the configuration of that embodiment. Some embodiments take corrective action when the slack exceeds a threshold or is more than a relative or absolute amount above a threshold; when the rate of slack formation exceeds a threshold; or when the embodiment otherwise detects that a risk of excess slack is imminent. For example, during a powered-assist operation, the motor controller 206 can be configured to adjust a rotation speed of the motor 204 to limit a length of unwound linear material between the spool member 202 and the spooling port 114 to less than a predetermined or dynamically computed length, and/or to substantially equalize the "unwind rate" (the translational rate of the linear material unwinding from the spool member 202) with the "pull-out rate" (the translational rate at which the linear material passes through the spooling port 114). In some embodiments, the sensor systems 402 and 404 can be used to maintain the amount of slack above (as opposed to below) a desired minimum (as opposed to maximum) threshold.

In the illustrated embodiment, the motor controller 206 can be configured to determine the appropriate corrective action for an excess (or insufficient) slack condition based on the current status of the motor 204 and the information received from the spool sensor system 402 (e.g., about the spool member 202) and the translation sensor system 404. For example, if there is too much slack and the spool member 202 is already winding in the linear material 122, the motor controller 206 may be configured to cause the motor 204 to rotate the spool member 202 at a faster rate. On the other hand, if the spool member 202 is unwinding, then the motor controller 206 can signal the motor 204 to cause the spool member 202 to unwind at a slower rate, to cease unwinding, or to reverse direction and wind in.

Some embodiments may allow the user to input, adjust, and/or control various slack-management parameters, by using the motor controller interface 208. For example, the interface 208 can allow a user to specify the maximum amount of permissible slack in the linear material between the spool member 202 and the spooling port 114 of the housing 102. Information entered by the user through the interface 208 is transmitted to the motor controller 206 for use in the monitor and control calculations. In other embodiments, the slack control system 400 does not allow a user to input, adjust, or control slack-management parameters. In such embodiments, the interface 208 plays no role in the slack control system 400.

Figure 5:
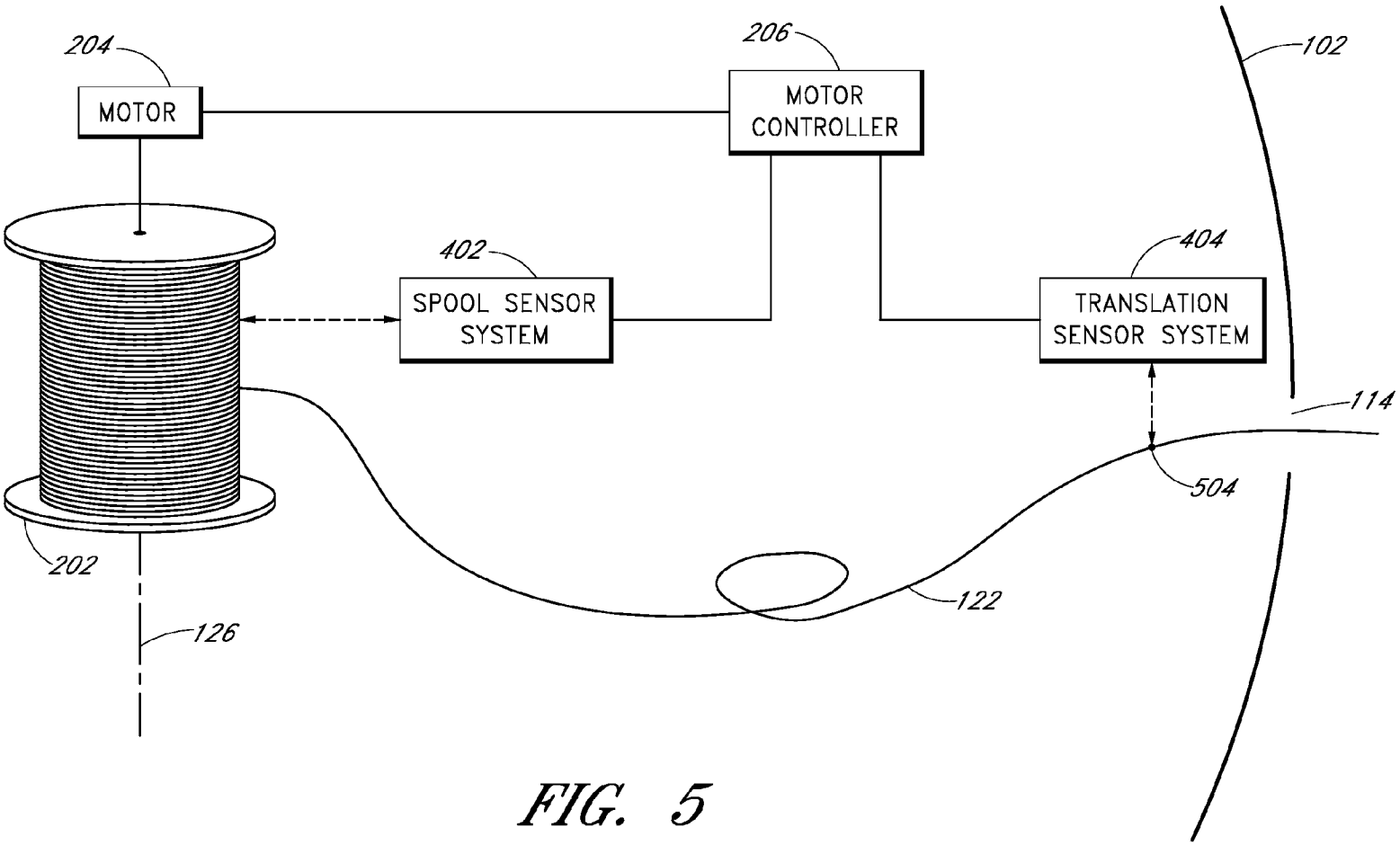
FIG. 5 is a schematic illustration of an embodiment of some elements of the slack control system of FIG. 4 in conjunction with an embodiment of an automatic reel.

In one embodiment, schematically illustrated in FIG. 5, the spool member 202 is positioned within the housing 102, as described above. Housing 102 has a spooling port 114 through which the linear material extends. In such an embodiment, the spool sensor system 402 is configured to monitor an amount of linear material 122 that winds upon or unwinds from the spool member 202, and/or to detect a rate at which the linear material 122 is wound upon or unwinds from the spool member 202. The translation sensor system 404 can be configured to monitor an amount of linear material 122 that passes a monitored location 504, and/or a rate at which the linear material 122 passes the monitored location 504. In a preferred embodiment, the monitored location 504 is proximate to the spooling port 114, but it will be understood that the monitored location 504 can be positioned either closer to or farther from the spool member 202, and even beyond the spooling port 114. The sensor systems 402 and 404 allow the slack control system 400 to monitor the amount of slack in the unwound portion of the linear material 122 that is within the housing 102. Such slack is generally formed during an unwind operation when more linear material 122 has unwound from the spool member 202 than has left the housing 102. However, slack can also be formed during a winding operation when more linear material 122 has entered the housing 102 through the spooling port 102 than has been wound onto the spool member 202.

Preferably, the translational movement of the linear material 122 (caused by winding or unwinding) between the monitored location 504 and the spooling port 114 is constrained to create a high degree of probability that any portion of linear material 122 that passes the location 504 passes unimpeded through the spooling port 114. One possible constraint is a tube (not shown) through which the linear material extends, the tube extending from the spooling port 114 and the monitored location 504 and having inner dimensions and configuration such that the linear material 122 is unlikely to snag or loop on itself within the tube.

The slack control system 400 is not limited to a system that is contained in a housing 102. Further, a slack control system can be used in systems that lack a rotatable spool member 202. Slack can form both from the winding or unwinding of linear material 122 with respect to the spool member 202, as well as from any other type of extension or return of linear material 122 with respect to a non-spooled linear material source. Embodiments of the invention are configured to monitor, report, and/or control linear material slack between any type of linear material source and a monitored location. In embodiments in which the source of linear material is not a spool, this can be achieved by the use of two or more translation sensor systems 404 at different locations, wherein the slack is formed between those locations. It will be understood that one of the translation sensor systems 404 can, but need not, be provided near the linear material source.

In embodiments in which the spool member 202 is located within a housing 102, the translation sensor system 404 of FIGS. 4 and 5 may be either internal or external to the housing 102. The translation sensor system 404 may be a separate apparatus that is physically independent from the housing 102 and any apparatus within the housing 102, or it may be attached or attachable to the housing 102 or physically coupled or attached to an apparatus within the housing 102. Whether the translation sensor system 404 is inside or outside the housing 102, it may communicate with the motor controller 206 via wired or physical connections and/or via wireless communication apparatus. As will be described in more detail below, some embodiments of the translation sensor system 404 comprise multiple components. Such components may communicate with each other via wired or wireless means. In some embodiments, all of the components of the translation sensor system 404 are within the housing 102. In other embodiments they are all outside the housing 102. In still other embodiments, some of the components are inside the housing 102 and some of them are outside the housing 102.

The translation sensor system 404, regardless of where it is located relative to the housing 102, may be configured to monitor a location inside the housing 102, outside the housing 102, or a point within the spooling port 114 where the linear material 122 passes from inside the housing 102 to outside the housing 102.

Figure 6:
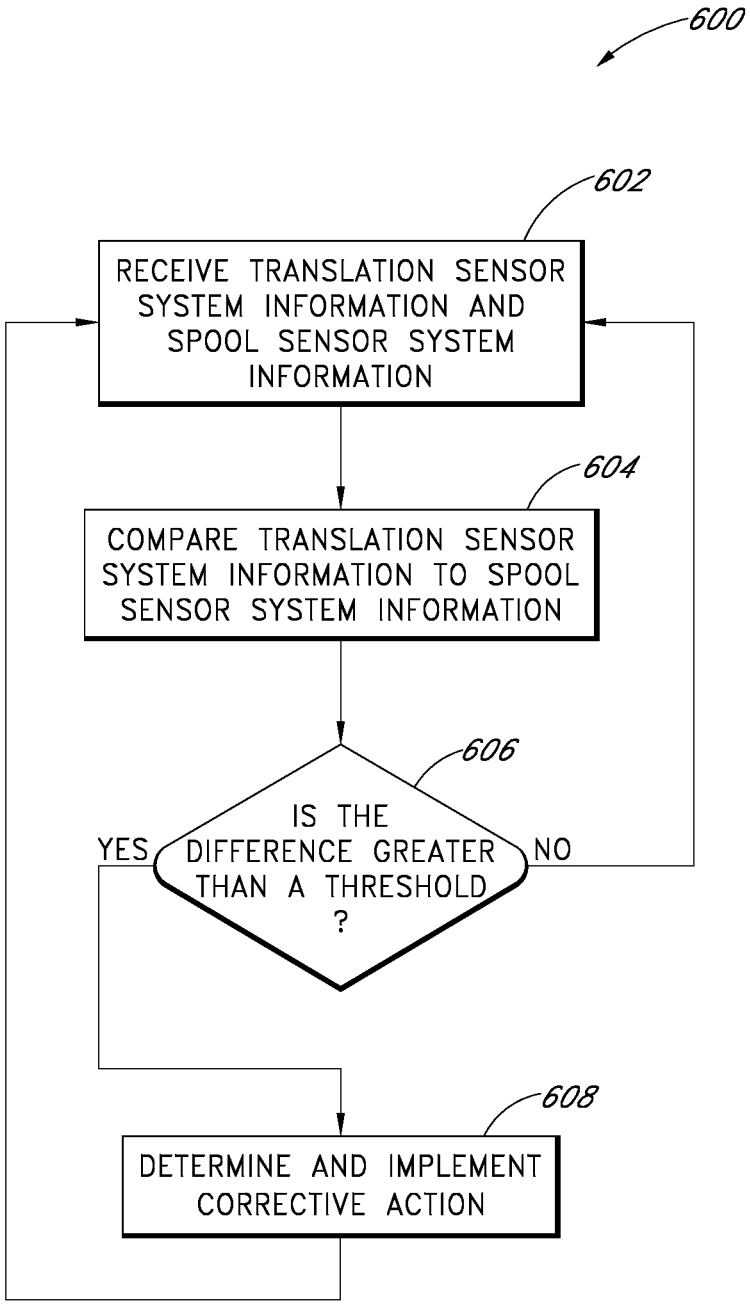
FIG. 6 is a flow chart of an embodiment of a slack control system.

FIG. 6 is a slack management flow chart 600 that illustrates an embodiment of a method by which slack that develops between a source of linear material 122 and a given location (e.g., location 504 of FIG. 5) can be monitored and controlled. In this particular embodiment, the slack control system 400 is substantially as shown in FIG. 4, comprising a spool sensor system 402 and a translation sensor system 404. In one embodiment, components of the slack control system 400 may interoperate according to the slack management flow chart 600. For example, in Block 602, the motor controller 206 receives information from the spool sensor system 402 about the rotation of the spool member 202 as described above. Also in Block 602, the motor controller 206 receives information from the translation sensor system 404. The information from the translation sensor system 404 may be a direct representation of the amount (typically length) of linear material 122 that passes a location 504 that the translation sensor system 404 monitors, or it may be information that serves as a proxy for such information or from which such information can be calculated by the motor controller 206. Examples of such indirect information are described below, in the discussion of specific embodiments of the translation sensor system 404.

In Block 604, the motor controller 206 compares the information about the spool member 202 (received from the spool sensor system 402) with the information from the translation sensor system 404. In Block 606, the motor controller 206 evaluates any difference in measured or calculated linear material translation (due to winding or unwinding) or rates of such translation between the two sets of information. If the difference is not greater than a particular threshold, the method returns to Block 602 for receipt of more information. If the difference is greater than the particular threshold, then the method proceeds to Block 608. The threshold value used in Block 606 may be set by a user using, for example, the motor controller interface 208; it may be dynamically set by the motor controller 206 based on algorithms and systems which, for example, account for the past behavior of the overall apparatus and the current state of the components of the apparatus (e.g., the size or number of spooled linear material layers on the spool member 202); it may be predetermined in the configuration of the slack control system 400; and/or it may be set by other systems and methods.

In Block 608, the motor controller 206 determines and implements an appropriate corrective action to counter excess linear material slack or rate of slack formation as determined in Block 604. For example, if the spool member 202 is unwinding, then the motor controller 206 can signal the motor 204 to cause the spool member 202 to unwind at a slower rate, to cease unwinding, or to reverse direction and wind in the linear material 122. On the other hand, if there is too much slack and the spool member 202 is already winding in the linear material 122, the motor controller 206 may be configured to cause the motor 204 to rotate the spool member 202 at a faster rate.

In other embodiments of methods of controlling slack, one or more of the steps shown in the slack management flow chart 600 are not performed. In some embodiments, additional processes are performed. It will be understood by one of skill in the art that various mechanisms, including those disclosed, can be used to compare information about the amount of linear material 122 released from or gathered into a source with the amount of linear material 122 that has passed a monitored location. Similarly, a variety of mechanisms, including those disclosed herein, can be used to decrease the rate at which slack develops and/or to reduce the amount of slack in the linear material 122.

Embodiments of a slack control system 400 are particularly useful when linear material 122 is being unwound from the spool member 202 and something, typically a user, is pulling the unwound linear material 122 away from the reel 100. At some point, the user may stop pulling the linear material 122 away from the spool member 202, and rotational momentum may cause the spool member 202 to continue unwinding linear material 122 even after the user stops pulling the linear material 122 away from the spool member 202. Or the linear material 122 may unwind at a rate faster than the user pulls it away from the spool member 202. For example, the motor 204 may cause the spool member 202 to unwind at a rate that is greater than the rate at which the linear material 122 is pulled away by the user. Also, a slack control system 400 can be implemented in linear material 122 dispensing systems that do not have the powered-assist functionality described above.

In embodiments that have powered-assist functionality, a slack control system can be used to improve the responsiveness and user experience. For example, the slack control system 400 may detect that slack is accumulating or increasing during a powered-assist operation. If the slack control system 400 detects that at least some linear material 122 is being pulled away from the spool member 202 through the translation sensor system 404, the motor controller 206 may be configured to respond to the increased slack by causing the powered-assist operation to at least temporarily stop (i.e., causing the motor 204 to stop rotating in the unwind direction) or by causing the motor 204 to rotate in the unwind direction at a slower rate more commensurate with the detected rate at which linear material 122 is being pulled through the translation sensor system 404. The motor controller's determination of whether to stop power-assisting (at least temporarily) versus simply power-assisting at a reduced rotational rate may depend on the total amount of slack that has accumulated within the linear material 122, with greater accumulated slack more likely to lead to an at least temporary cessation of the powered-assist operation. Similarly, if the slack control system 400 detects a cessation in the outward pull of the linear material 122 from the reel 100 (e.g., by detecting that no linear material is translating through the translation sensor system 404), the motor controller 206 can be configured to respond by stopping the powered-assist operation, and possibly even by causing the motor 204 to rotate in the wind-up direction to eliminate some or all of any slack that has formed.

Spool Sensor System

Figure 7:
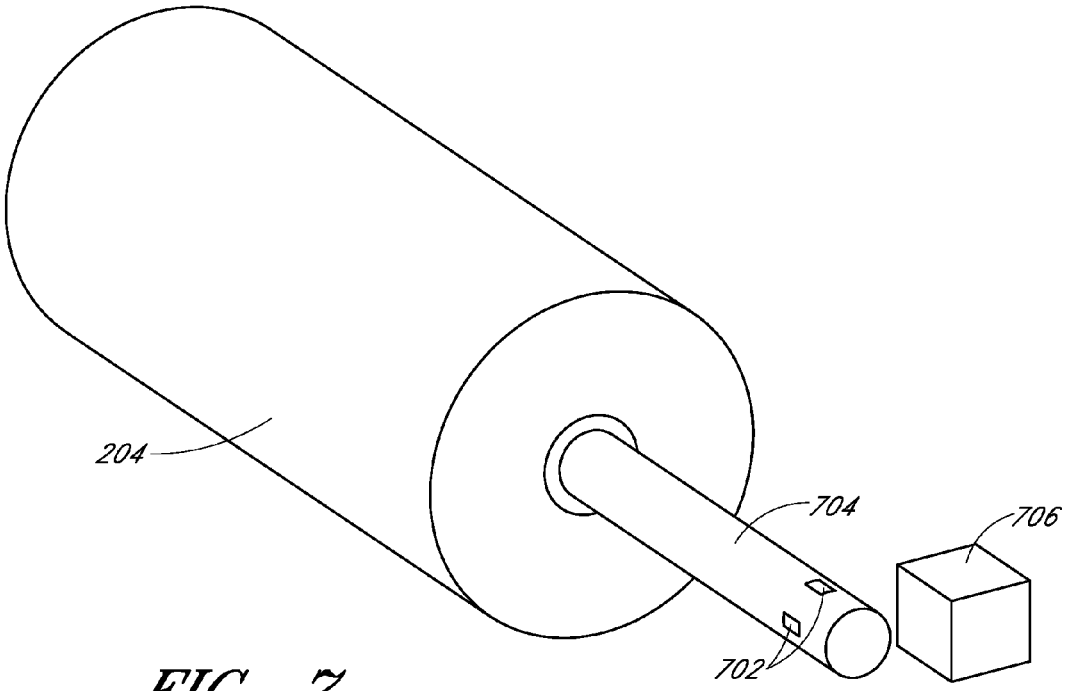
FIG. 7 is a perspective view of an embodiment of a spool sensor system associated with a motor.
Figure 8:
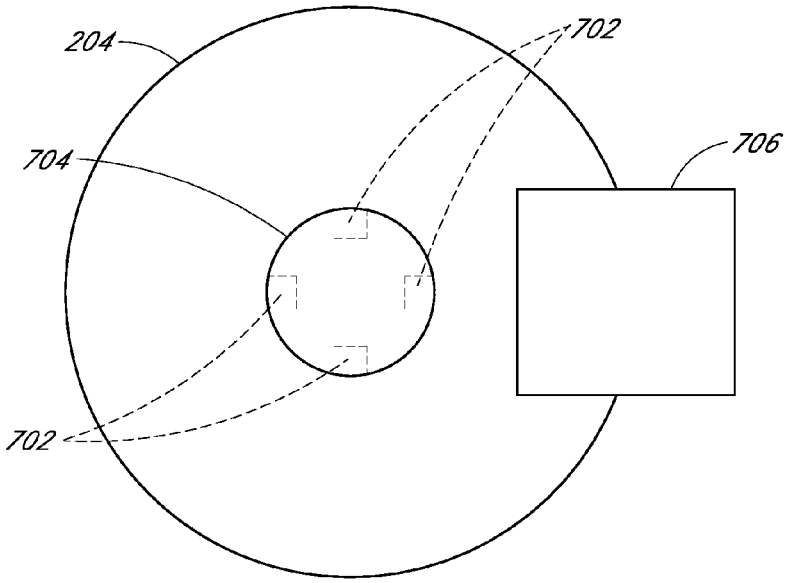
FIG. 8 is an end view of the spool sensor system and motor of FIG. 7.
Figure 9:
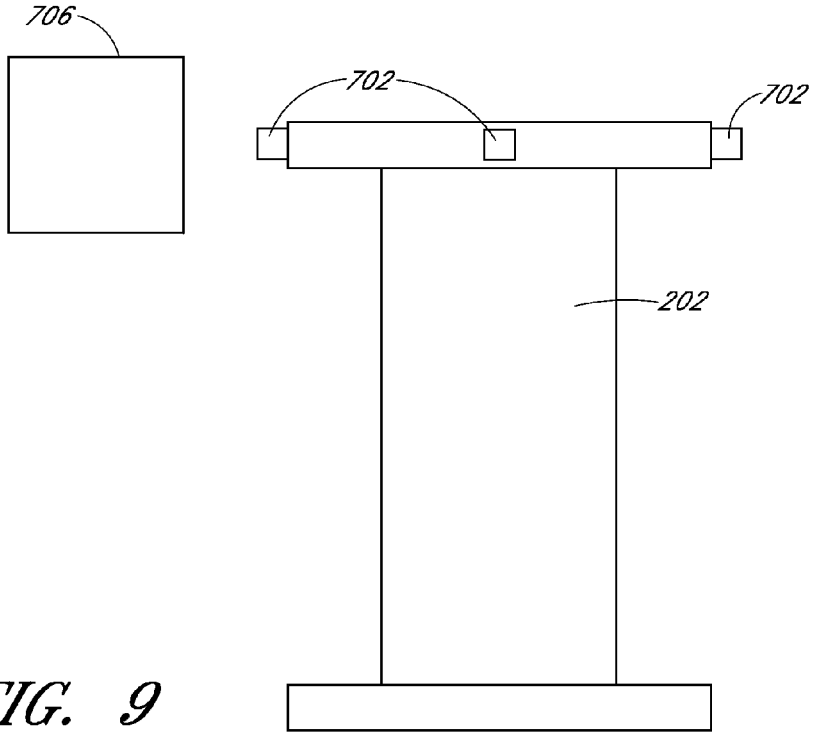
FIG. 9 is a top view of an embodiment of a spool sensor system associated with a spool member.
Figure 10:
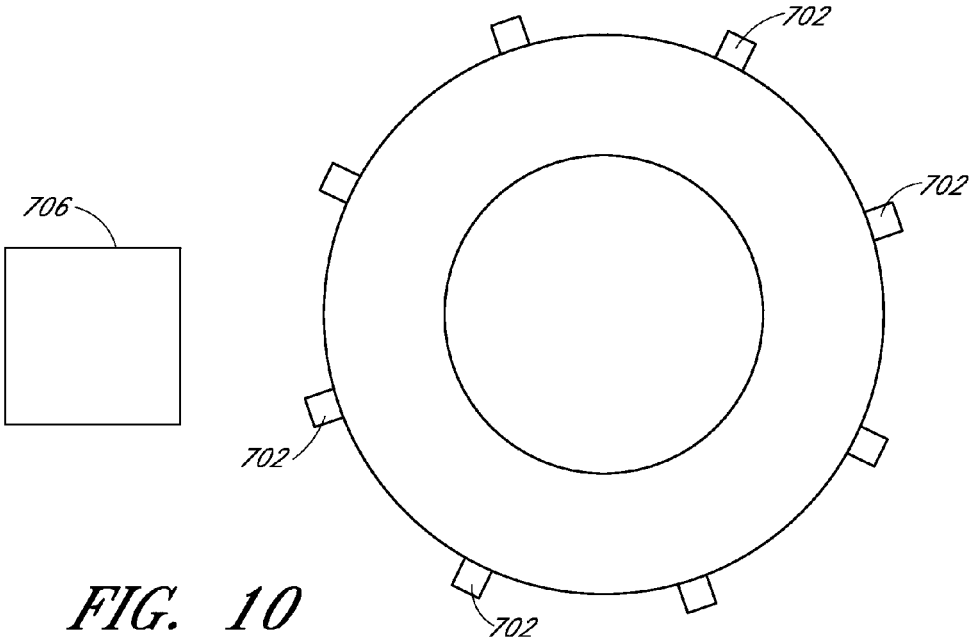
FIG. 10 is an end view of the spool sensor system and spool member of FIG. 9.

FIGS. 7-10 depict illustrative examples of two embodiments of spool sensor systems that monitor the amount of linear material unwound from or remaining wound upon the spool member 202 of a reel, through the use of sensors such as Hall Effect sensors or optical sensors. FIGS. 7-8 illustrate an embodiment in which the spool sensor system directly detects revolutions of an output shaft 704 of the motor 204, while FIGS. 9-10 illustrate an embodiment in which the spool sensor system directly detects revolutions of a spool member 202. In either case, a sensor 706 can be configured to generate an electronic "pulse" corresponding to each detected revolution. The sensor 706 can be configured to generate and send an electronic signal comprising a plurality of such pulses, so that the signal is indicative of the monitored revolutions of the shaft 704. The motor controller 206 or a separate controller can be configured to use this signal to determine the translational movement or velocity of linear material being wound upon or unwound from the spool member 202. During a powered-assist operation, the motor controller 206 can be configured to detect the unwind rate (from the spool member 202) at least partly from this electronic signal.

As shown in FIGS. 7-8, one or more sources or elements 702, such as magnets, reflectors, or lights, are associated with (e.g., disposed on) a shaft or axle 704 that is operationally rotated (directly or indirectly) by the motor 204. Each such element 702 encircles an axis of rotation of the shaft 704 as the shaft 704 rotates. At least one sensor 706 detects the passage in close proximity (e.g., within about 0.25 inches to 2 inches) of each of the sources 702 as the shaft 704 rotates. For example, when a source 702 passes in close proximity of the sensor 706, the sensor 706 can detect that a source 702 has passed. The relative positioning of the sensor 706 and the sources 702 is preferably selected in accordance with their respective properties, as will be understood by those skilled in the art. In some embodiments, this sensor/source mechanism may be wholly or partially integrated with the motor 204 such that when an embodiment of an automatic reel is assembled, a motor controller 206 is operationally connected to the sensor/source mechanism of the motor 204 and receives, via that connection, signals indicative of the rotation of the motor shaft 704 as measured by one or more integrated sensors 706 and sources 702. FIGS. 7-8 illustrate the same embodiment from different perspectives, involving the use of four sources 702.

Embodiments may use multiple sources 702 and/or multiple sensors 706 to enable the motor controller 206 to detect rotational velocity of the shaft 704 and/or spool member 202. Generally, the more sources 702 or sensors 706 are used, the more precise a measurement of rotational velocity or displacement the sensor 706 can detect, up until the point at which the sources 702 are so close to one another that they interfere with each other and cannot be distinguished by the sensor 706. Embodiments may have two, three, four, or more sensors 706. The sensors 706 may be arranged regularly (e.g., at equal circumferential intervals) around the monitored rotating component containing the sources 702, or may alternatively be grouped closer to each other, as shown in FIGS. 12-15 (discussed below). Multiple sensors 706 may provide redundancy of measurement, mitigating the risk of failure of one or more of the sensors. For example, circuitry associated with the sensor/source mechanism may detect failure of one or more sensors 706 and rely upon input from remaining non-failed sensors 706, may weight data depending on how many sensors 706 report it, or use any of a variety of approaches known to those of skill in the art for achieving redundancy and failure support from multiple inputs.

Similarly, embodiments may also have two, three, four, or more sources 702. The sources 702 may be arranged regularly (e.g., at equal circumferential intervals) about the monitored rotating component containing the sources 702, or may alternatively be grouped closer to each other. Multiple sources 702 may also provide redundancy of measurement, mitigating the risk of failure of one or more of the sources. For example, circuitry associated with the sensor/source mechanism may detect failure of one or more sources 702 and rely upon input from remaining non-failed sources 702, may weight data depending on how many sources 702 report it, or use any of a variety of approaches known to those of skill in the art for achieving redundancy and failure support from multiple inputs.

Embodiments may use multiple sensors 706 or multiple sources 702 to determine changes in direction of rotation of a monitored rotating component. For example, suppose a shaft/sensor assembly has first and second sensors 706. If rotation of the shaft 704 is detected (e.g., proximity detection of an identifiable source 702) twice consecutively by the first sensor 706 without an intervening detection by the second sensor 706, the motor controller 206 may conclude that the direction of rotation of the shaft 704 has changed. In another example, suppose a shaft/sensor assembly has first and second sources 702 and at least one sensor 706. If the sensor 706 detects the first source 702 twice consecutively without an intervening detection of the second source 702, the motor controller 206 may conclude that the direction of rotation of the shaft 704 has changed. It will further be appreciated that such methods for detecting changes in direction of rotation can be used in embodiments in which the sources 702 are mounted on the spool member 202 or another element that rotates when the spool member 202 rotates about its winding axis.

Control logic and heuristics for a sensor/source mechanism may be contained in software or control circuitry associated with the mechanism. For example, sensor 706 can be interfaced with a microprocessor. In other embodiments, some or all of that logic and heuristics may be provided in a different controller (which may also use software, hardware, or a combination thereof), such as motor controller 206. A portion of the control logic may be configured to convert observations or data from the one or more sensors 706 to data indicative of the rate and/or direction of rotation of the output shaft 704 of the motor 204. The control logic may do so based on the number and relative positioning of sources 702 and sensors 706. In some embodiments, the control logic may also factor in a predefined relationship between the rate of rotation of the shaft 704 and the motor 204. For example, consider an embodiment with two sensors 706 circumferentially spaced apart by 180° about the shaft 704, and two sources 702 also circumferentially spaced apart by 180° about the shaft 704. In this example, a portion of the control logic might determine that when, over a period of one second, the sensors 706 collectively detected sources 702 four times, then the shaft 704 is rotating at approximately 0.5 to 1.0 revolutions per second (with more information about the initial relative positions of the sensors 706 and sources 702, more precision may be possible). In another example involving the same embodiment, the control logic may observe that it took approximately one second after the first source 702 detection by a sensor 706 for a fourth source 702 detection to be made, and may conclude that the shaft 704 is rotating at approximately 0.5 revolutions per second. A rate and/or direction of rotation of the motor 204 can be determined based on a known or assumed relationship between the rotation of the motor 204 and the rotation of the shaft 704 (which may or may not be one-to-one). In some embodiments, the motor controller 206 receives the output of the sensor(s) 706 and determines, from the sensor output, the rate and/or direction of rotation. In some embodiments, separate control logic (e.g., electronic circuitry and/or a logic chip) provided in conjunction with the sensor(s) 706 and/or source(s) 702 is configured to use the sensor output to determine the rate and/or direction of rotation and to communicate that information to the motor controller 206.

Another way in which an embodiment including sources 702 and sensors 706 can determine both the amount and the direction of rotation of the shaft 704 (or, as shown in FIGS. 9-10, the spool member 202) and thereby calculate a net amount of rotation is through detection of phase shifting or the like. For example, opto-isolator sensors or other optical sensors can detect not just the passing of the sources 702 into proximity of the sensors 706, but also the phase shifting of the signals associated with those sources. The phase shift indicates the direction of rotation.

Sources 702 and sensors 706 may be similarly configured with respect to any rotating member or component of the reel 100 if, for example, there is a known relationship between the rotational displacement of the component and the amount of linear material wound or unwound while that component is rotating through the rotational displacement. Just as, in some embodiments, each revolution or portion of a revolution of a motor shaft 704 corresponds to a calculable length of linear material being wound or unwound from the spool member 202, in some embodiments the rotation of elements of a gearbox of the reel device 100 may have a similar relationship such that the sensor-source apparatus is configured to monitor the rotation of a gear operatively coupled with respect to the motor 204 and the spool member 202. Or, as illustrated in FIGS. 9-10, the rotation of the spool member 202 can be directly monitored using sensors 706 and sources 702. FIGS. 9-10 illustrate the sources 702 mounted on the spool member 202, preferably at positions at which they will typically not be covered by wound linear material or at which their detection by sensor 706 will not otherwise be impeded. In some embodiments, the positions of the sources 702 and sensors 706 can be switched with each other, such that the sensors 706 are disposed on the rotatable component (e.g., the motor shaft 704, spool member 202, or a gear element interposed therebetween), and the sources 702 are positioned in proximity thereto.

In general, the number of sources 702 and the number of sensors 706 can vary independently. For example, an embodiment could be configured with multiple sensors 706 and one source 702, or with multiple sensors 706 and multiple sources 702. As stated above, it is typically the case that having more sources 702 and/or sensors 706 may result in a more precise or finer-grained measurement. Such embodiments may also be more tolerant of failure of one or more sources 702 or sensors 706. It will also be understood that in embodiments where the coupling or engagement between the motor 204 and the spool member 202 is geared, a sensor/source configuration associated with the motor (e.g., as in FIGS. 7-8) or otherwise measuring rotation of the motor's output shaft 704 (as opposed to the spool member 202 or a gear or gear shaft operatively coupled between the shaft 704 and the spool member 202) may be more precise than the same configuration associated with the spool member 202 after the gearing (as in FIGS. 9-10). For example, if two sources 702 are circumferentially spaced apart by 180° about the shaft 704 or spool member 202, and every half revolution can be detected by a single sensor 706, the sensor 706 will be able to report on half revolution increments of the output shaft 704 of the motor 204 (in the embodiment of FIGS. 7-8) or the spool member 202 (in the embodiment of FIGS. 9-10). Suppose that a half revolution of the spool member 202 corresponds to the spooling or unspooling of 12 inches of linear material, depending on factors such as those discussed above, including the amount of linear material currently on the spool member 202 (which affects the spool diameter). A half revolution of the motor shaft 704, if the device 100 has a 30:1 gear ratio, would correspond to the spooling or unspooling of 0.4 inches of linear material. Thus, placing the sensing apparatus on or near the motor shaft 704 may allow the reel's control system to more finely measure the rotational displacement or velocity of the component on which the sources 702 are disposed, or the translational velocity of the linear material. However, there may be operational or production reasons to mount the sensor apparatus in association with the spool member 202, e.g., further from any heat emitted by the motor 204 and closer to the spool member 202.

As mentioned above, sensors 706 and sources 702, whether they are optical, magnetic, or otherwise, may have their own circuitry for calculating a net number of revolutions and/or rotational velocity in the winding or unwinding direction. The spool sensor system can be configured to send or make such information available to the motor controller 206. Alternatively, the spool sensor system can be configured to send pulses (each pulse being indicative of one passage of a source 702 in proximity to a sensor 706) to the motor controller 206, which can be configured to determine the number of revolutions and/or rotational velocity from the pulses. The motor controller 206 can be configured to use this information to manage slack in the linear material, as disclosed herein.

FIGS. 11 through 15 provide illustrative examples of motor and sensor assemblies that can be used to achieve one or more advantages described herein. Any combination of features described in reference to FIGS. 11 through 15 can be implemented in connection with the principles and advantages of any of the methods or apparatuses described herein, as appropriate.

Figure 11:
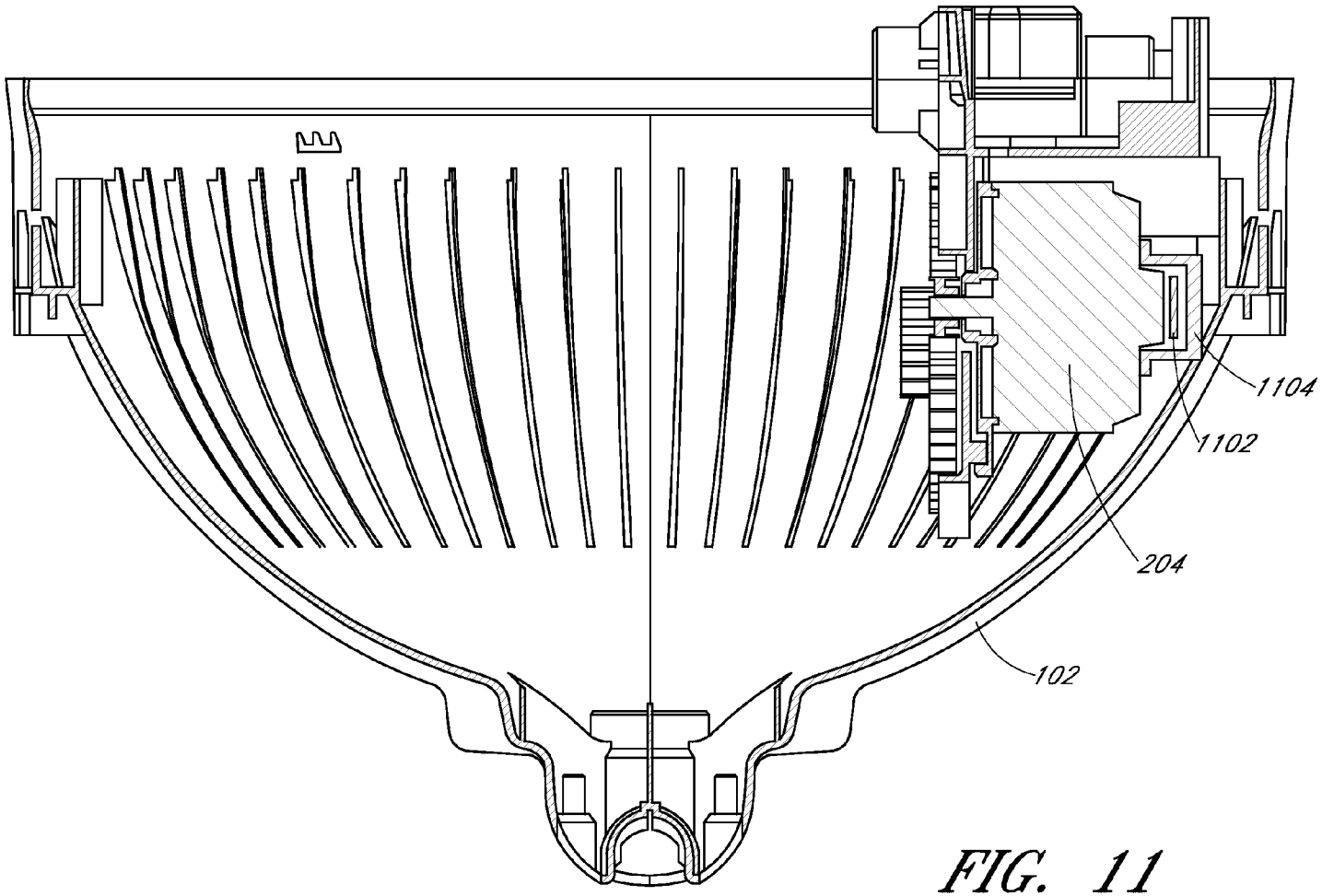
FIG. 11 is a side view of a portion of an embodiment of a reel having a spool sensor system integrated with a motor.

FIG. 11 illustrates an embodiment including a motor 204 with an integrated sensor/source apparatus. One such embodiment may use a motor 204 such as the 300.B086 from Linix Motor. In FIG. 11, the integrated sensor/source apparatus comprises a disc 1102 associated with motor 204 via a shaft such as shaft 704 (not visible in FIG. 11, but shown in FIGS. 7-8). The association between the motor 204 and disc 1102 is preferably such that the disc 1102 rotates at the rate and in the direction of the rotation of the output shaft 704 of the motor 204, although certain embodiments may have different operational relationships between the motor 204 and disc 1102 (e.g., rotational velocity ratios different than one-to-one). In some embodiments, the disc 1102 is mounted directly on the shaft 704. In some embodiments, the shaft 704 protrudes from opposing ends of a casing of the motor 204, and the disc 1102 can be mounted on the shaft 704 on either end of the casing. Surrounding the illustrated disc 1102 is a cap 1104, which serves to protect the disc 1102, the sensors 706, and other components of the motor 204. The cap 1104 can be formed of any material, such as plastic. Cap 1104 is optional. In some embodiments, cap 1104 may be removed from the motor 204. In other embodiments, cap 1104 is substantially permanently attached to the motor 204. Similarly, disc 1102, motor 204, and shaft 704 may be removably or substantially permanently attached to each other, by appropriate means known to those of skill in the art.

Figure 12:
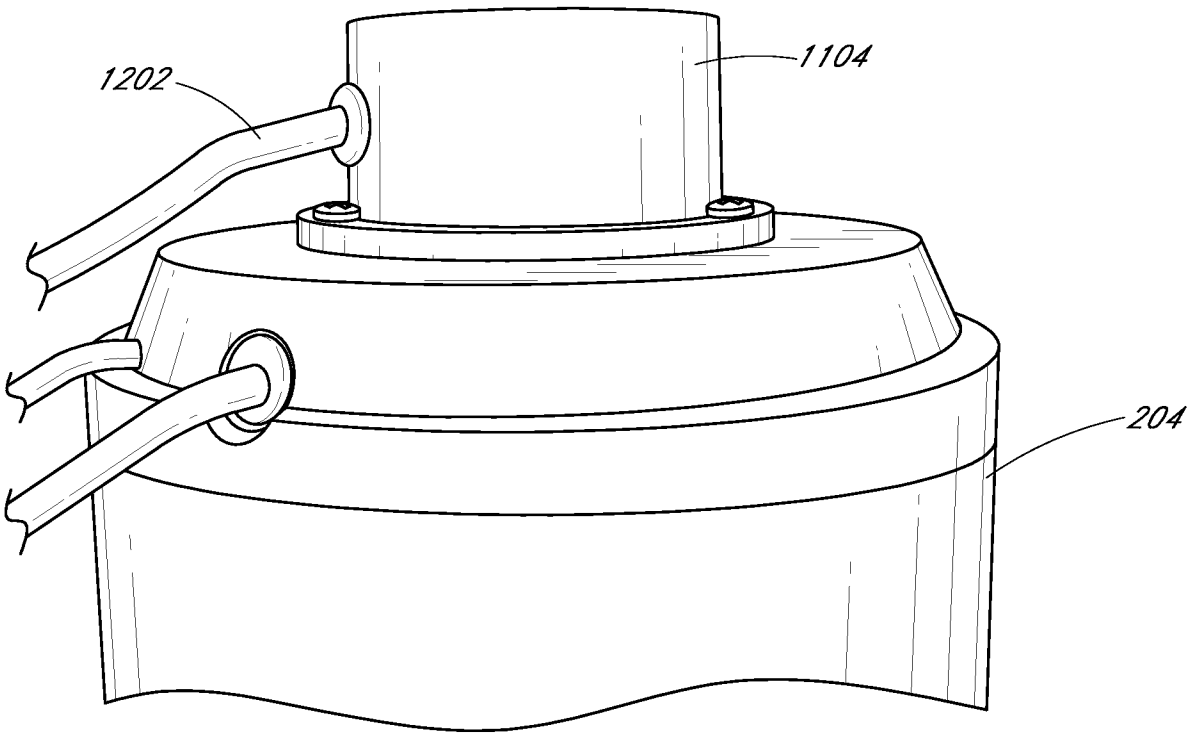
FIG. 12 is a perspective view of a cap and motor assembly of FIG. 11.

FIG. 12 shows cap 1104 attached to motor 204 via one or more screws, for example. Also shown is a data communication line 1202 (e.g., a single- or multi-wire cable), capable of sending the sensor-derived information described above (the output of the sensor(s) 706 and associated control circuitry). Data communication line 1202 may be bidirectional, or there may be separate input and output lines. In addition to confirmation that output was received, data that might be input to a sensor 706 and/or its associated control circuitry includes configuration information such as data related to the number and positions of sources 702 and sensors 706, which a sensor 706 and/or associated control circuitry might use when formulating its output, for example.

Figure 13:
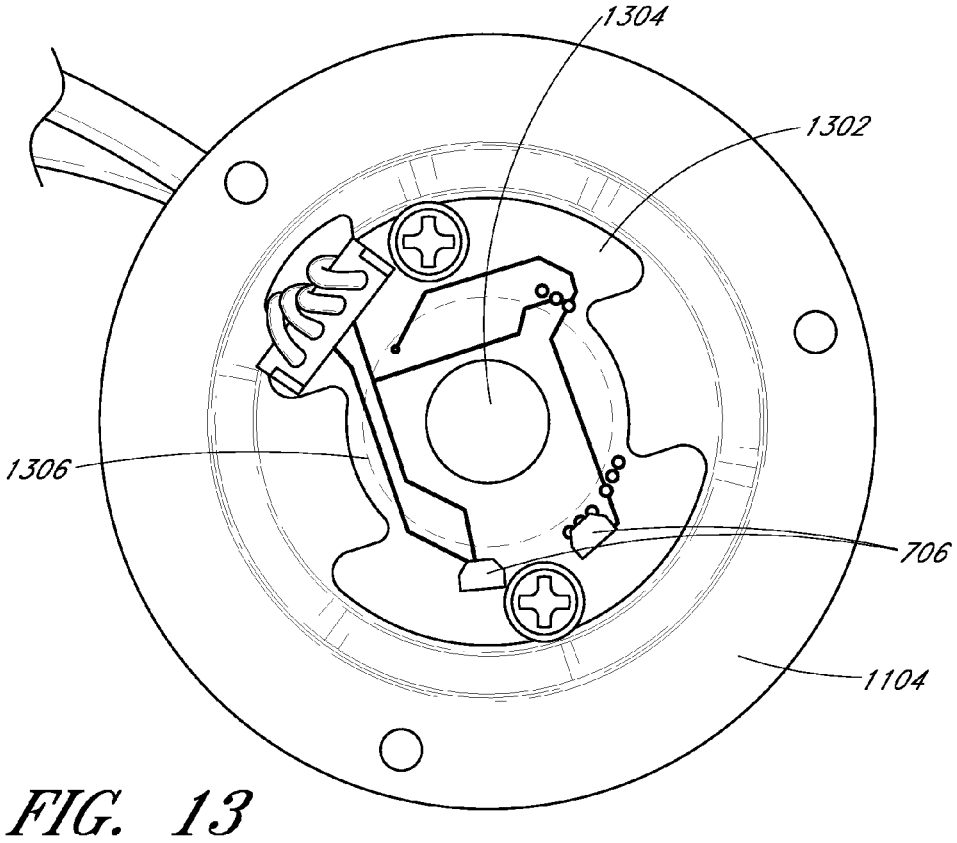
FIG. 13 is an interior view of the cap and a sensor assembly of FIG. 11.
Figure 14:
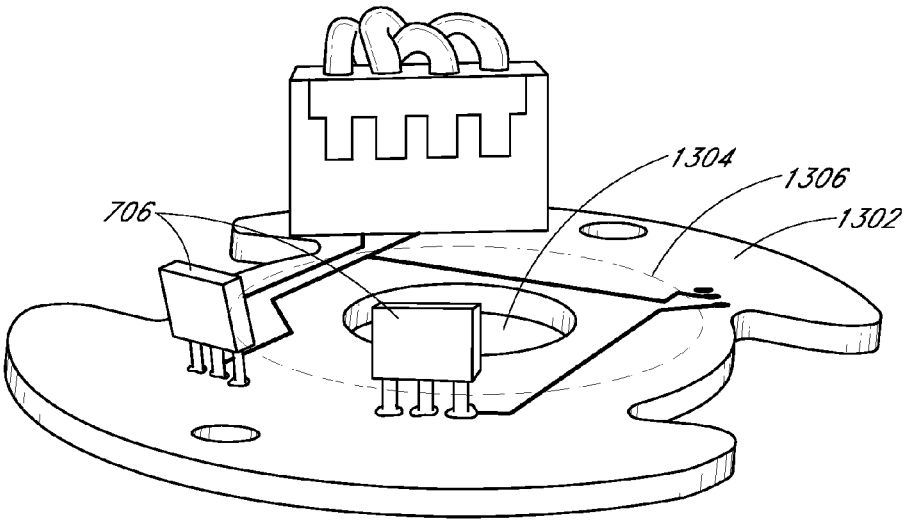
FIG. 14 is a perspective view of a sensor assembly insert mountable within the cap of FIG. 11.

FIG. 13 shows a sensor assembly insert 1302 mounted within an interior of the cap 1104. The insert 1302 supports one or more sensors 706 (such as Hall Effect sensors) and associated electronic circuitry and/or logic componentry. In certain embodiments, the insert 1302 comprises a circuit board, such as a PCBA. In the illustrated embodiment, two sensors 706 are used. The illustrated sensors 706 are not evenly or regularly distributed about the perimeter of the motor axis, but are instead positioned relatively near one another. Such a configuration, particularly when combined with appropriate logic in an associated controller, may be advantageously redundant in that if one sensor 706 should fail, another sensor 706 can take its place. In other embodiments, the sensor(s) 706 and associated electronic circuitry can be provided directly on the cap 1104, without a separate insert 1302. FIG. 14 shows the insert 1302 removed from the cap 1104. In other embodiments, the insert 1302 may be substantially permanently affixed to the cap 1104. Providing some degree of non-destructive access to the sensors 706 and associated circuitry, be it in the form of no cap 1104, a removable cap 1104, or otherwise, advantageously allows access to those components for repair, replacement, or maintenance, for example.

Figure 15:
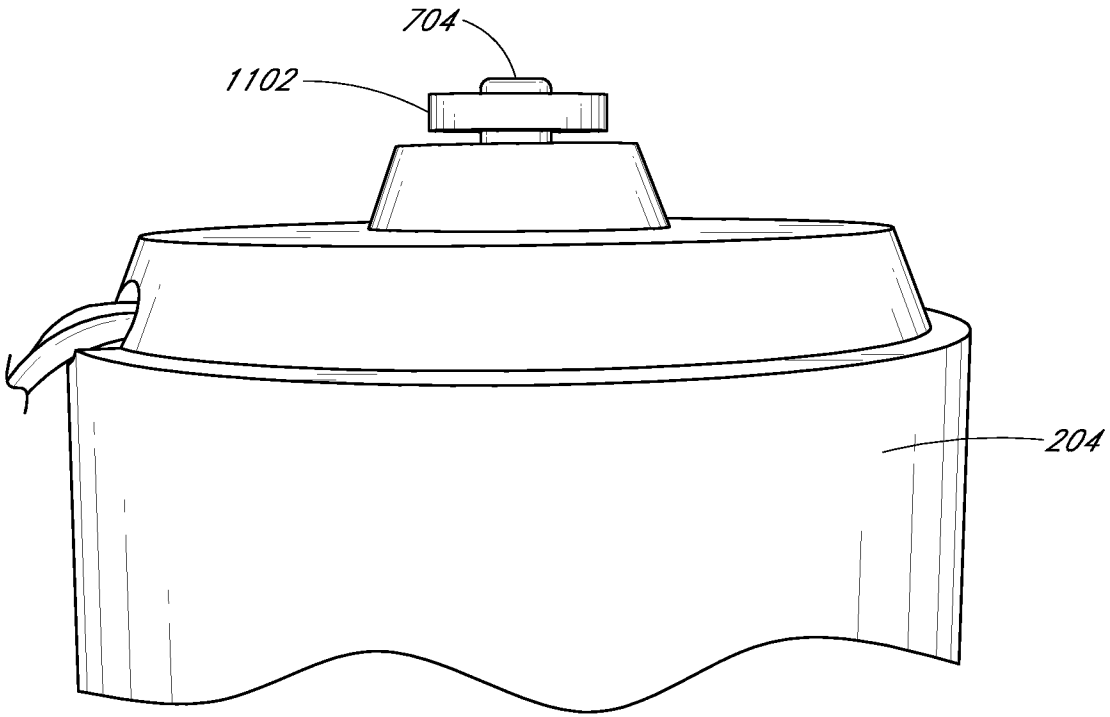
FIG. 15 is a side view of the motor and a rotating disc of FIG. 11.

FIG. 15 shows the motor 204 with the cap 1104 removed. The disc 1102 may be attached (either removably or non-removably) to a shaft such as shaft 704, which is rotatably connected to the motor 204. Disc 1102 preferably includes one or more embedded or otherwise attached magnets, which are sources 702 (FIGS. 7-8). In other embodiments, with appropriately configured sensors 706, different types and numbers of sources 702 may be used, as discussed above. Referring again to FIG. 13, cap 1104, to which sensors 706 are attached (either removably or non-removably), is attached (either removably or non-removably) to motor 204 so that, for example, the shaft 704 can extend through a hole 1304 in the insert 1302 and the disc 1102 is substantially aligned with the circle 1306 shown in broken line. In operation, the rotation of the disc 1102, which is indicative of the rotation of the output shaft 704 of the motor 204, is detected and/or measured by the sensors 706. In the illustrated embodiment, the rotation of the magnets of the disc 1102 induces a voltage change across the Hall Effect sensors 706, and it is that voltage (or an associated current, for example) which is detected and reported by the sensors 706. In other embodiments, the sensors 706 may be photosensitive and the disc 1102 may contain appropriate light sources 702 instead of or in addition to magnets. In any case, each sensor 706 can respond to its detections of sources 702 passing into close proximity of the sensor by generating an electronic pulse, as discussed above.

One of skill in the art will appreciate that while disc 1102 with embedded magnets may have certain advantages in terms of rotational stability or mechanics, for example, the one or more sources 702 need not be embedded in or otherwise provided on such a disc 1102 and may, for example, be directly attached to shaft 704.

A sensor/source apparatus such as those illustrated and described herein may be configured to have a particular accuracy and/or precision in measuring rotational displacement and/or velocity. For example, it may detect full or partial revolutions, depending in part on the associated control logic and the number of sensors 706 and sources 702. An apparatus with a single sensor 706 and a single source 702 may detect only single revolutions. The use and positioning of sensors 706 and sources 702, as well as the configuration of associated control logic, may allow measuring of ½, ⅓, ¼ as well as many other fractions of a revolution. Further, the measurement accuracy may also depend in part on the speed of rotation as well as the type and quality of the components. Also, some algorithms may yield precise measurements of the rate of rotation, while other algorithms may yield ranges. Embodiments may use one or both types of algorithms.

Translation Sensor System

The translation sensor system 404 may comprise any apparatus that is capable of tracking the amount of linear material 122 that passes a location 504 that the translation sensor system 404 monitors. Alternatively or additionally, the apparatus can be capable of providing information from which the rate of linear material translation (due to winding or unwinding) at the location 504 can be tracked. As noted above, the motor controller 206 can compare the output of the translation sensor system 404 with information from the spool sensor system 402 (e.g., information about the number and direction of revolutions of the spool member 202) or with information from another translation sensor system 404 near the spool member 202 to determine if a critical amount of linear material 122 is slackened between the monitored location 504 and the spool member 202.

Figure 16:
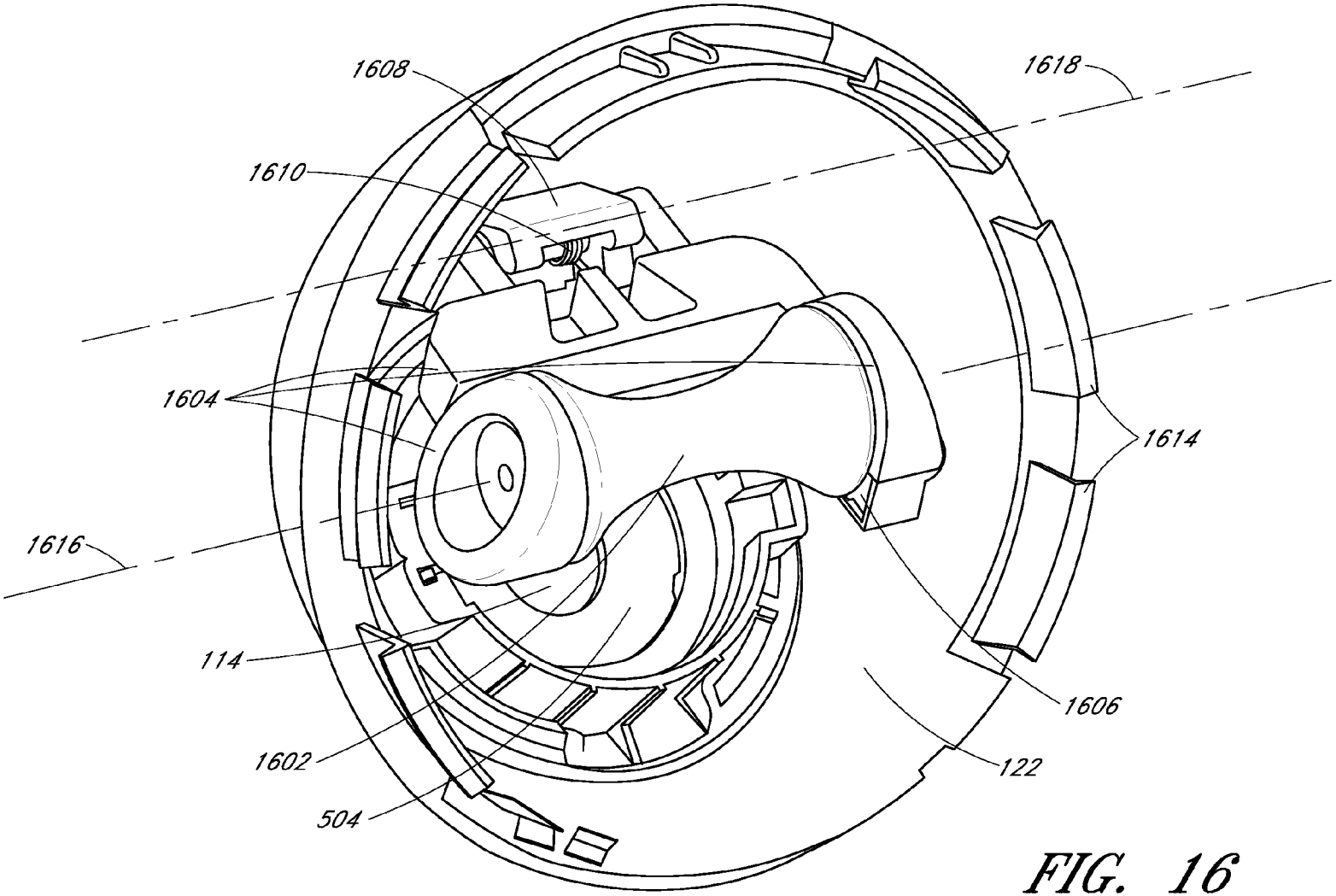
FIG. 16 is a rear-left perspective view of an embodiment of a translation sensor system.

FIG. 16 illustrates an embodiment of a translation sensor system 404. In the illustrated embodiment, the sensor system 404 is mounted within a nose cone 120 attached to the reel housing 102, as shown in FIGS. 1B and 1C. In this embodiment, the spooling port 114 is formed within the nose cone 120. The nose cone 120 may attach to the housing 102 via snap-fit tabs 1614.

The illustrated translation sensor system 404 comprises a roller 1602 mounted with respect to the reel housing 102, preferably in proximity to (e.g., within four inches) the spooling port 114. The illustrated translation sensor system 404 further comprises a cradle 1604, a sensor 1606, and a nose cone attachment 1608. The linear material 122 can enter and leave the housing 102 through the spooling port 114. The attachment 1608 is mounted to an inner surface of the nose cone 120, and the cradle 1604 can be pivotably mounted to the attachment 1608, permitting a degree of pivoting or rotation of the cradle 1604 with respect to the attachment 1608 about a pivot axis 1618. The roller 1602 is rotatably mounted to the cradle 1604, such as by a center axle or axle pins, to permit the roller 1602 to rotate with respect to the cradle 1604 about a roller axis 1616. The roller 120 is preferably mounted such that the linear material 122 bears against an outer annular surface of the roller 1602 when the linear material 122 extends through the spooling port 114, and such that translation of the linear material 122 through the spooling port 114 (e.g., in conjunction with winding or unwinding of the spool member 202) causes the roller 1602 to rotate with respect to the housing 102 about the roller axis 1616.

The cradle 1604 and attachment 1608 can be mounted to position the roller 1602 above or below the linear material 122 when the linear material extends through the spooling port 114. While the illustrated embodiment shows the roller 1602 above the spooling port 114, it may be preferable to position the roller 1602 below the port 114, to promote better contact between the linear material 122 and the roller 1602 (due to gravity acting on the linear material).

It will be understood that the angle, lateral position, and/or relative altitude or height at which the linear material 122 approaches the roller 1602 may change depending on, among other things, the portion of the spool member 202 from which it is wound or unwound. Although the illustrated translation sensor system 404 is configured to monitor a particular location 504, in some embodiments additional structure is provided to ensure that the linear material 122 passes that location 504 and/or that the monitored location 504 is adjusted to where the linear material 122 passes. For example, the roller 1602 can be biased toward the linear material 122. In the illustrated embodiment in which the roller 1602 is positioned above the spooling port 114, the attachment 1608, cradle 1604, and roller 1602 are preferably configured so that the roller 1602 is downwardly biased to exert a downward force on the linear material 122 as the linear material translates through the spooling port 114. In some embodiments, one or more springs 1610 bias the cradle 1604 so as to pivot downwardly with respect to the attachment 1608 about the pivot axis 1618. In this manner, the springs 1610 help to account for the variability in the position of the linear material 122 and to ensure that the roller 1602 rotates as the linear material 122 translates through the spooling port 114. The combination of the biasing force of the roller 1602 against the linear material 122 and the friction between the linear material and the surface of the roller 1602 causes the roller 1602 to rotate as the linear material 122 translates due to winding or unwinding.

In addition to the aforementioned pivoting of the cradle 1604 with respect to the attachment 1608, the cradle 1604 and/or attachment 1608 can be configured to allow positional adjustment in other ways. For example, the cradle 1604 and/or attachment 1618 can be configured to rotate about an axis that is substantially perpendicular to the pivot axis 1618 and/or the roller axis 1616. Further the cradle 1604 and/or attachment 1608 can be configured to permit a degree of translation of the cradle 1604 relative to the nose cone 120 along such an axis.

Figure 17:
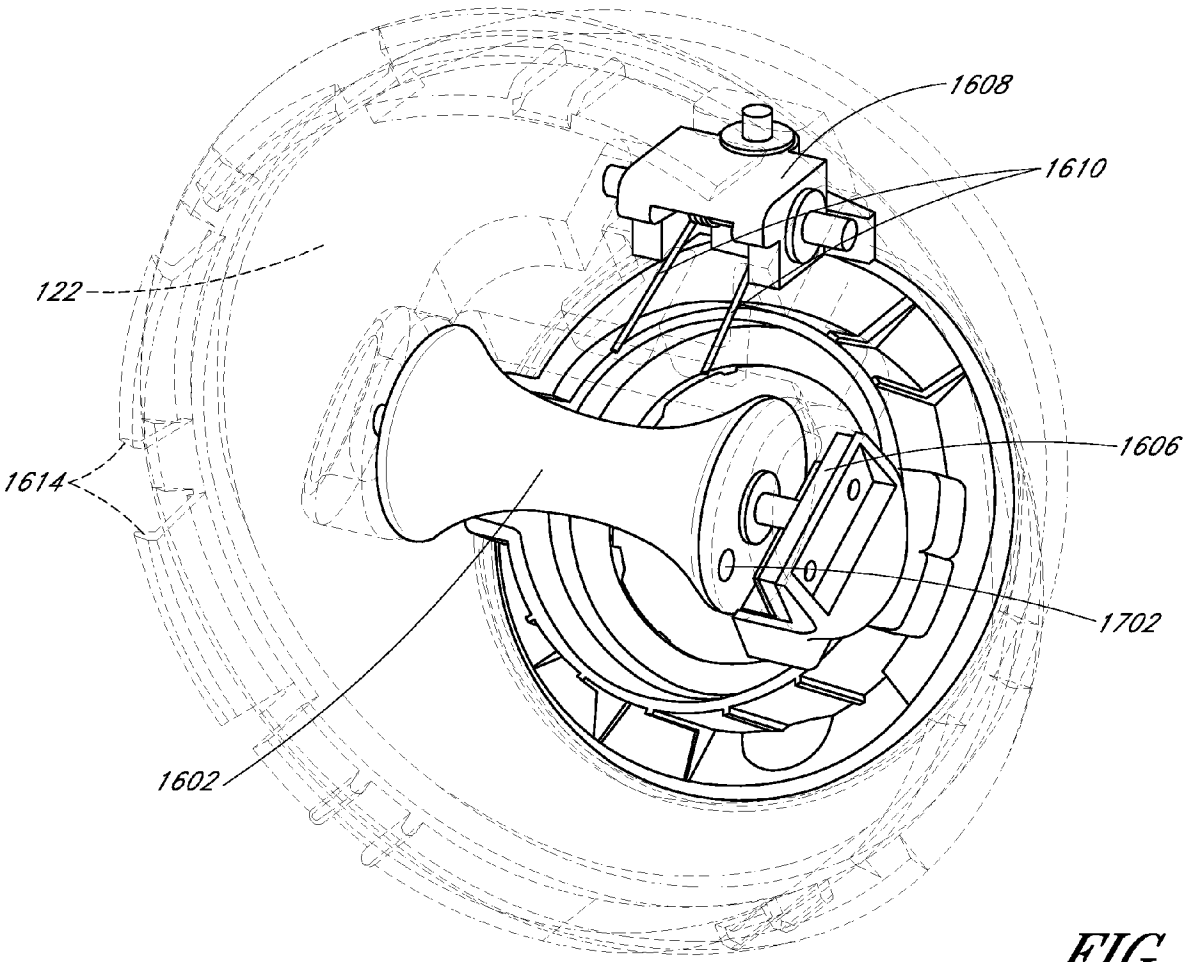
FIG. 17 is a rear-right perspective view of the translation sensor system of FIG. 16.

FIG. 17 shows the assembly of FIG. 16 with the nose cone 122 and cradle 1604 shown in broken lines. As shown in FIG. 17, the roller 1602 can include one or more elements 1702 disposed on the roller 1602, such as in an end surface of the roller 1602 as shown. The sensor 1606 can comprise any device capable of detecting instances of an element 1702 passing into close proximity of the sensor 1606. For example, an element 1702 can comprise a magnet, and the sensor 1606 can comprise a Hall Effect sensor. In another example, a light-sensitive sensor 1606 may detect light reflected or generated by an optical element 1702. The sensor 1606 detects revolutions of the roller 1602 by sensing each instance of one of the elements 1702 passing within close proximity of the sensor 1606 during the rotation of the roller 1602 about the roller axis 1616. In other embodiments, one or more magnetic or optical elements 1702 are alternatively located in the circumference or annular perimeter of the roller 1602, with the sensor 1606 appropriately positioned to detect instances of the elements 1702 passing into close proximity of the sensor 1606. In either configuration, the sensor 1606 can be configured to generate an electronic or electromagnetic signal or "pulse" corresponding to each detected instance. The sensor 1606 can be configured to transmit information about the amount and possibly direction of rotation of the roller 1602 to the motor controller 206. For instance, the sensor 1606 can be configured to send the pulses to the motor controller 206.

The motor controller 206 can be configured to count the pulses to determine a length of linear material 122 that has passed through the monitored location 504 over a period of time, or a translational velocity of the linear material (based on pulses per unit time). The motor controller 206 can determine the length of linear material that has passed the monitored location 504 based on the number of detected revolutions of the roller 1602 and the circumference of the roller 1602. In other embodiments, the sensor 1606 includes a separate controller that itself counts the pulses and/or determines the translational velocity of the linear material and sends such information to the motor controller 206.

The illustrated roller 1602 has an outer annular surface with a somewhat concave longitudinal profile. Various factors, including the way in which the linear material 122 is wrapped around the spool member 202, can induce a certain amount of lateral variability in the lateral position of the linear material 122 with respect to the roller 1602. The range of lateral motion may depend on the size of the spool member 202 and the distance between the roller 1602 and the spool member 202. The illustrated concave profile of the roller 1602 helps to promote better contact between the linear material 122 and the roller 1602 during winding and unwinding. In some embodiments, the length of the roller 1602 can be as large as or larger than the expected range of lateral motion. In such embodiments, a roller 1602 that is generally cylindrical may be used without an unduly high risk of the linear material 122 sliding or jumping off of the roller 1602. In embodiments where the roller 1602 is not that long, and even in embodiments where it is, a roller 1602 having a concave, tapered, or saddle shape helps direct the linear material 122 back towards the center of the roller 1602 and reduces the likelihood of the linear material 122 jumping or sliding completely off of it. The degree of tapering can be chosen based on the properties of the overall automatic reel system 100, the size and nature of the linear material 122, and the materials and design of the particular embodiment. As can be seen in FIG. 16, the sensor 1606 extends below the roller 1602. This extension also helps to keep the linear material 122 from jumping or sliding beyond the length of the roller 1602.

One parameter involved in calculating the length of linear material 122 that translates past the roller 1602 is the circumference of the roller. In embodiments having a non-cylindrical roller 1602 as shown in FIGS. 16 and 17, the circumference varies along the length of the roller 1602, complicating the calculation. One revolution of the illustrated roller 1602 with the linear material 122 at the center of the roller corresponds to a shorter linear material translation than one revolution of the roller 1602 with the linear material 122 at the end of the roller. This is because the roller circumference of the illustrated roller 1602 is larger at the end than at the center of the roller. In embodiments with non-uniformly sized rollers, an "average circumference" can be determined empirically and programmed into the motor controller 206. In use, the position of the linear material typically varies along the length of the roller 1602. Empirical analyses can determine a time-averaged roller circumference reflective of the time-averaged point of contact between the linear material 122 and roller 1602. This time-averaged roller circumference can then be used by the motor controller 206 to calculate the length of linear material 132 that passes the roller over a period of time, and/or the translational velocity of the linear material 122 at the roller 1602. It will be understood that the time-averaged roller circumference may depend on the type, weight, and size of the linear material, and that different empirical studies may be conducted for different linear materials.

Figure 18:
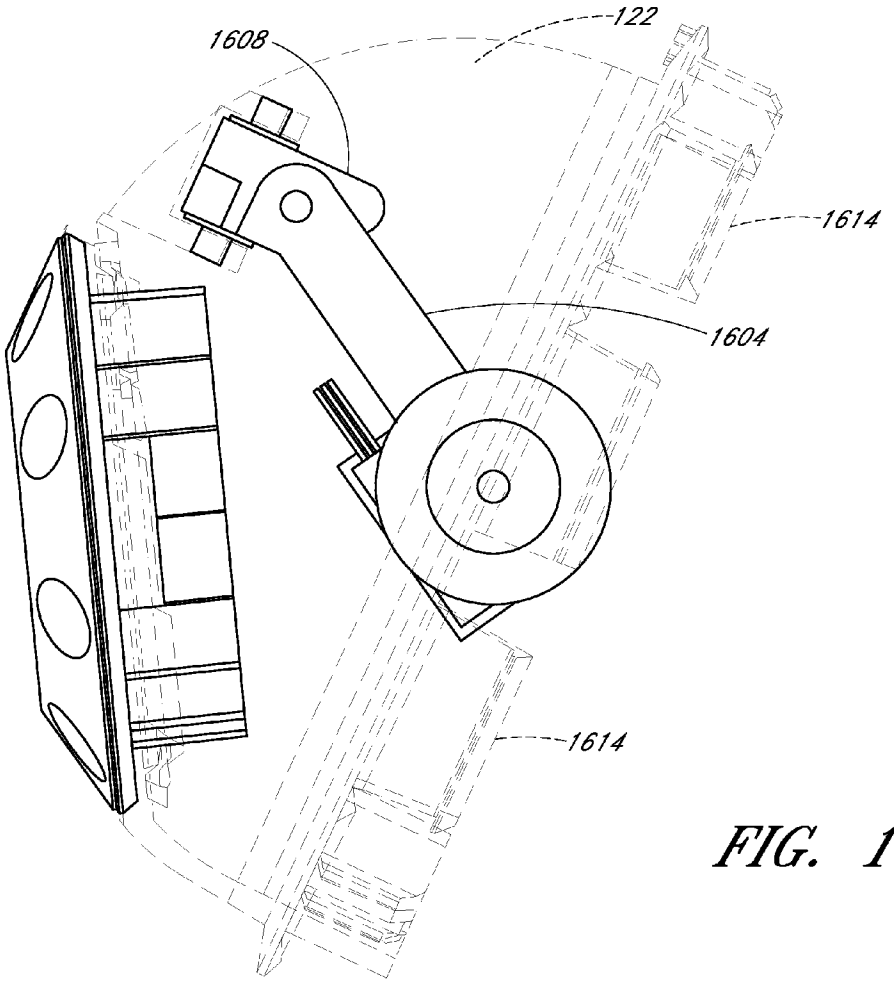
FIG. 18 is a side view of the translation sensor system of FIG. 16.

FIG. 18 is a side view of the nose cone 120 and above-described components of the transmission sensor system 404. In FIG. 18, the nose cone 122 is shown in broken lines.

Figure 19:
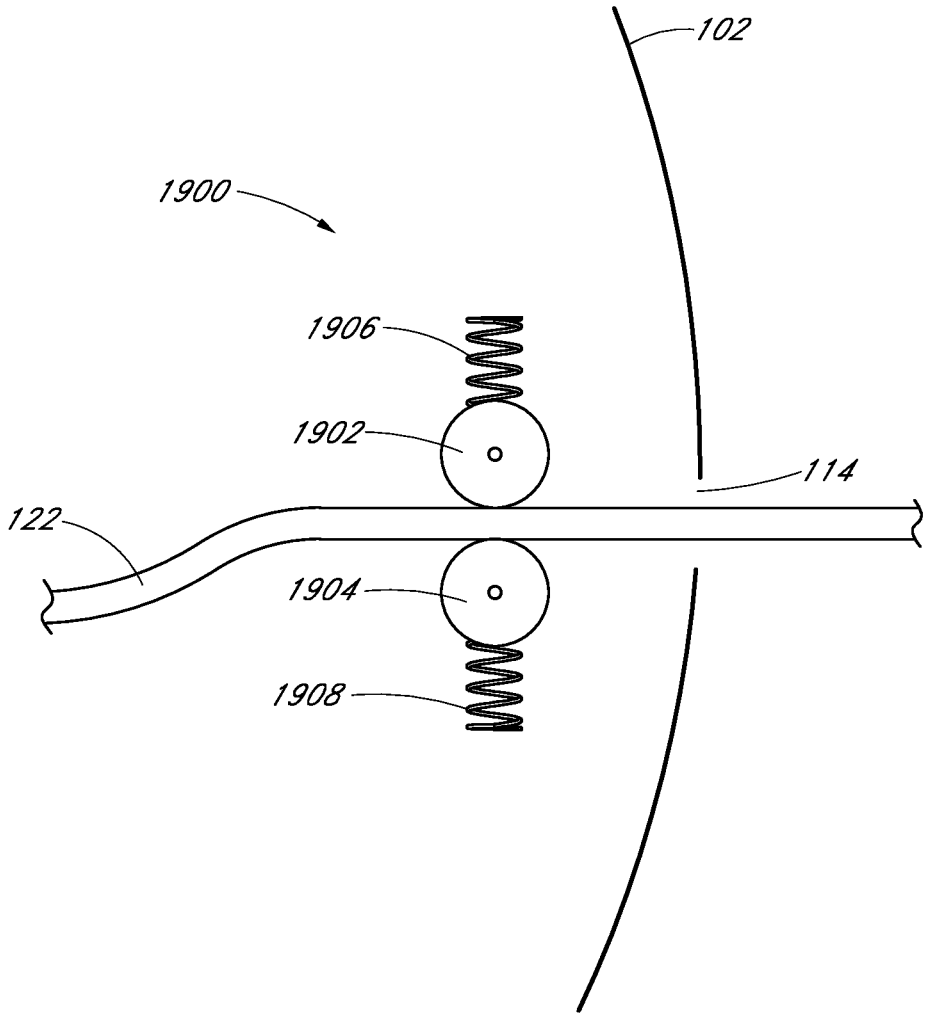
FIG. 19 is a schematic illustration of an alternative embodiment of a translation sensor system.

FIG. 19 conceptually illustrates another embodiment of a transmission sensor system 1900, comprising a pair of rollers 1902 and 1904. Preferably, the two rollers 1902 and 1904 are configured to sandwich the linear material 122 therebetween. Providing two rollers increases the likelihood that the transmission sensor system 1900 will detect translation of the linear material at or near the spooling port 114 of the housing 102. In the event that one of the two rollers is rotating while the other is not, the motor controller 206 can be configured to use rotation data from the rotating roller and to ignore the non-rotating roller. Similarly, in the event that one of the two rollers is rotating more or faster than the other roller, the motor controller 206 can be configured to use rotation data from the roller that is rotating more or faster and to ignore the other roller. This reflects the possibility that the linear material 122 might contact only one of the two rollers while translating through the spooling port 114, such that only the rotation data of the roller that the linear material contacts provides an accurate measurement of the rate of translation of the linear material 122 through the spooling port 114.

In the illustrated embodiment, springs 1906 and 1908 can be included to bias the rollers 1902 and 1904 toward one another. Using springs 1906 and 1908 tends to cause both rollers 1902 and 1904 to contact the linear material 122 to the same degree, which in turn promotes the likelihood that both rollers will rotate at the same speed as the linear material 122 translates through the spooling port 122.

In certain embodiments, the rollers 1902 and/or 1904 (as well as the roller 1602 shown in FIGS. 16-18) can be configured so that there is some degree of resistance to rotation of the roller. This can inhibit rotation of the roller when the linear material 122 does not contact the roller, such as rotation caused by rotational inertia (e.g., rotation of the roller due to inertia after the translating linear material 122 stops contacting the roller).

While the illustrated rollers 1902 and 1904 are oriented horizontally, it will be understood that the rollers can have any suitable orientation, such as vertical or diagonal. Further, while the illustrated rollers 1902 and 1904 are oriented in parallel with each other, in some embodiments they can be non-parallel to each other, so long as they are capable of sandwiching the linear material 122 between their outer surfaces.

It will be understood that the linear material 122 is not a required element of the invention. Some embodiments comprise reels that do not include the linear material, but which are configured to be used with a user-provided linear material. More generally, no element described herein is necessarily required, unless specifically disclosed as such.

Having thus described certain embodiments of the present invention, those of skill in the art will readily appreciate from the disclosure herein that yet other embodiments may be made and used within the scope of the claims hereto attached. Numerous advantages of the invention covered by this disclosure have been set forth in the foregoing description. It will be understood, however, that this disclosure is, in many respects, only illustrative. Changes may be made in details without exceeding the scope of the disclosure.

What is claimed is:

1. A reel comprising:

a linear material;

a spool member rotatable about a winding axis, the spool member configured to rotate in a wind direction about the winding axis to wind the linear material about the spool member, the spool member configured to rotate in an unwind direction about the winding axis to unwind the linear material from the spool member;

a motor configured to rotate the spool member about the winding axis;

a housing surrounding the spool member and the motor, the housing having a spooling port through which the linear material extends;

a motor controller configured to detect when the linear material is pulled from the spool member through the port, and to respond to the detected pulling of the linear material by conducting a powered-assist operation in which the motor controller operates the motor to rotate the spool member about the winding axis in the unwind direction;

a spool sensor system configured to be used by the motor controller to detect an unwind rate at which the linear material is unwound from the spool member during the powered-assist operation; and a translation sensor system configured to be used by the motor controller to detect a pull-out rate at which the linear material is pulled through the port in the unwind direction during the powered-assist operation;

wherein the motor controller is configured to adjust a rotation speed of the motor during the powered-assist operation based at least partly on the unwind rate and the pull-out rate, in order to limit a length of unwound linear material between the spool member and the port to less than a predetermined length.

2. The reel of claim 1, wherein the spool sensor system comprises at least one sensor configured to monitor revolutions of a rotating member and to send an electronic signal indicative of said monitored revolutions to the motor controller, the motor controller configured to detect the unwind rate at least partly from said signal.

3. The reel of claim 2, wherein the rotating member comprises the spool member.

4. The reel of claim 2, wherein the rotating member comprises an output shaft of the motor.

5. The reel of claim 2, wherein the at least one sensor comprise a Hall Effect sensor.

6. The reel of claim 2, wherein:

the rotating member includes at least one element that encircles an axis of rotation of the rotating member as the rotating member rotates; and the at least one sensor is configured to monitor revolutions of the rotating member by detecting instances of the at least one element passing in proximity to the sensor during rotation of the rotating member.

7. The reel of claim 1, wherein the translation sensor system comprises:

a roller mounted with respect to the housing in proximity to the port such that the linear material bears against an outer annular surface of the roller, and such that translation of the linear material through the port causes the roller to rotate with respect to the housing about a roller axis, the roller including at least one element that encircles the roller axis as the roller rotates; and at least one sensor configured to detect instances of the at least one element passing in proximity to the sensor during the rotation of the roller.

8. The reel of claim 7, wherein the roller is spring-biased toward the linear material.

9. The reel of claim 7, wherein the sensor comprises a Hall Effect sensor.

10. The reel of claim 1, wherein the translation sensor system comprises:

a first roller mounted with respect to the housing in proximity to the port, the first roller being rotatable with respect to the housing about a first roller axis, the first roller including an element that encircles the first roller axis as the first roller rotates;

a second roller mounted with respect to the housing in proximity to the port, the second roller being rotatable with respect to the housing about a second roller axis, the second roller including an element that encircles the second roller axis as the second roller rotates;

a first sensor configured to detect instances of the element of the first roller passing in proximity to the first sensor during rotation of the first roller; and a second sensor configured to detect instances of the element of the second roller passing in proximity to the second sensor during rotation of the second roller;

wherein the linear material extends between outer annular surfaces of the first and second rollers, and translation of the linear material through the port causes at least one of the rollers to rotate.

11. The reel of claim 10, wherein the first and second rollers are spring-biased toward each other with the linear material therebetween.

12. The reel of claim 10, wherein the translation sensor system is configured to:

determine a rate of instances of the element of the first roller passing in proximity to the first sensor during the powered-assist operation;

determine a rate of instances of the element of the second roller passing in proximity to the second sensor during the powered-assist operation;

determine which of said rates of instances is greater; and determine the pull-out rate at least partly from said greater rate of instances.

13. The reel of claim 1, wherein the motor controller is configured to adjust the rotation speed of the motor during the powered-assist operation to substantially equalize the unwind rate and the pull-out rate.

14. A method comprising:

providing a linear material connected to a rotatable spool member housed within a housing, the spool member being rotatable about a winding axis, the spool member configured to rotate in a wind direction about the winding axis to wind the linear material about the spool member, the spool member configured to rotate in an unwind direction about the winding axis to unwind the linear material from the spool member, the housing having a port through which the linear material extends;

detecting the linear material being pulled from the spool member through the port by a user;

responding to the detected pulling of the linear material by conducting a powered-assist operation in which a motor rotates the spool member about the winding axis in the unwind direction;

detecting an unwind rate at which the linear material is unwound from the spool member during the powered-assist operation;

detecting a pull-out rate at which the linear material is pulled manually by the user through the port in the unwind direction during the powered-assist operation; and adjusting a rotation speed of the motor during the powered-assist operation based at least partly on the unwind rate and the pull-out rate, in order to limit a length of unwound linear material between the spool member and the port to less than a predetermined length.

15. The method of claim 14, wherein detecting the unwind rate comprises:

using at least one sensor to monitor revolutions of a rotating member; and determining the unwind rate at least partly from the monitored revolutions.

16. The method of claim 15, wherein the rotating member comprises the spool member.

17. The method of claim 15, wherein the rotating member comprises an output shaft of the motor.

18. The method of claim 15, wherein the at least one sensor comprises a Hall Effect sensor.

19. The method of claim 15, wherein:

the rotating member includes at least one element that encircles an axis of rotation of the rotating member as the rotating member rotates; and using the at least one sensor to monitor revolutions of the rotating member comprises using the at least one sensor to detect instances of the at least one element passing in proximity to the sensor during rotation of the rotating member.

20. The method of claim 14, wherein detecting the pull-out rate comprises:

providing a roller mounted with respect to the housing in proximity to the port such that the linear material bears against an outer annular surface of the roller, and such that translation of the linear material through the port causes the roller to rotate with respect to the housing about a roller axis, the roller including at least one element that encircles the roller axis as the roller rotates; and using at least one sensor to detect instances of the at least one element passing in proximity to the sensor during the rotation of the roller.

21. The method of claim 20, further comprising spring-biasing the roller toward the linear material during said powered-assist operation.

22. The method of claim 14, wherein detecting the pull-out rate comprises:

providing a first roller mounted with respect to the housing in proximity to the port, the first roller being rotatable with respect to the housing about a first roller axis, the first roller including an element that encircles the first roller axis as the first roller rotates;

providing a second roller mounted with respect to the housing in proximity to the port, the second roller being rotatable with respect to the housing about a second roller axis, the second roller including an element that encircles the second roller axis as the second roller rotates;

using a first sensor to detect instances of the element of the first roller passing in proximity to the first sensor during rotation of the first roller; and using a second sensor to detect instances of the element of the second roller passing in proximity to the second sensor during rotation of the second roller;

wherein the linear material extends between outer annular surfaces of the first and second rollers, and translation of the linear material through the port causes at least one of the rollers to rotate.

23. The method of claim 22, further comprising spring-biasing the first and second rollers toward each other with the linear material therebetween, during said powered-assist operation.

24. The method of claim 22, wherein detecting the pull-out rate further comprises:

determining a rate of instances of the element of the first roller passing in proximity to the first sensor during the powered-assist operation;

determining a rate of instances of the element of the second roller passing in proximity to the second sensor during the powered-assist operation;

determining which of said rates of instances is greater; and determining the pull-out rate at least partly from said greater rate of instances.

25. The method of claim 14, further comprising adjusting the rotation speed of the motor during the powered-assist operation to substantially equalize the unwind rate and the pull-out rate.

26. A reel comprising:

a linear material;

a spool member rotatable about a winding axis, the spool member configured to rotate in a wind direction about the winding axis to wind the linear material about the spool member, the spool member configured to rotate in an unwind direction about the winding axis to unwind the linear material from the spool member;

a motor configured to rotate the spool member about the winding axis;

a housing surrounding the spool member and the motor, the housing having a spooling port through which the linear material extends;

a motor controller configured to control rotation of the motor;

a spool sensor system configured to be used by the motor controller to detect a first rate at which the linear material is wound upon or unwound from the spool member; and a translation sensor system configured to be used by the motor controller to detect a second rate at which the linear material translates through the port in the wind direction or the unwind direction;

wherein the motor controller is configured to control the motor based at least partly on the first and second rates, in order to limit a length of unwound linear material between the spool member and the port to less than a predetermined length.

27. The reel of claim 26, wherein the motor controller is configured to control the motor to substantially equalize the first and second rates.

* * * * *